US009279290B2

(12) United States Patent
Stewart et al.

(10) Patent No.: US 9,279,290 B2
(45) Date of Patent: Mar. 8, 2016

(54) MANUFACTURE OF CUTTING ELEMENTS HAVING LOBES

(71) Applicant: Smith International, Inc., Houston, TX (US)

(72) Inventors: Michael Stewart, Spring, TX (US); Yi Fang, Orem, UT (US); Scott L. Horman, Provo, UT (US); Jeremy Peterson, Cedar Hills, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 32 days.

(21) Appl. No.: 14/141,804

(22) Filed: Dec. 27, 2013

(65) Prior Publication Data

US 2014/0183800 A1 Jul. 3, 2014

Related U.S. Application Data

(60) Provisional application No. 61/746,758, filed on Dec. 28, 2012.

(51) Int. Cl.

| | |
|---|---|
| ***B22F 3/12*** | (2006.01) |
| ***B28B 3/02*** | (2006.01) |
| ***E21B 10/36*** | (2006.01) |
| ***C23C 24/08*** | (2006.01) |
| ***E21B 10/46*** | (2006.01) |

(52) U.S. Cl.

CPC ..... *E21B 10/36* (2013.01); *B22F 3/1208* (2013.01); *C23C 24/085* (2013.01); *E21B 10/46* (2013.01)

(58) Field of Classification Search

CPC ..... B28B 3/02; B28B 3/021; B22F 2003/153; B22F 3/15; B22F 3/1208

USPC ..... 264/671

See application file for complete search history.

(56) References Cited

U.S. PATENT DOCUMENTS

| | | | |
|---|---|---|---|
| 1,649,858 | A | 11/1927 | Reed |
| 2,578,593 | A | 12/1951 | Phipps |
| 2,990,025 | A | 6/1961 | Talbert |
| 3,388,757 | A | 6/1968 | Fittinger |
| 3,442,342 | A | 5/1969 | McElya et al. |
| 3,542,142 | A | 11/1970 | Haslba et al. |
| 3,599,737 | A | 8/1971 | Fischer et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,162,900 | A | 7/1979 | Judd |

(Continued)

FOREIGN PATENT DOCUMENTS

| | | | |
|---|---|---|---|
| EP | 0154936 | A2 | 9/1985 |
| EP | 0902159 | A2 | 3/1989 |

(Continued)

*Primary Examiner* — Erin Snelting

(57) ABSTRACT

An apparatus for forming a cutting insert may include a compression device having a sleeve with a bore. The sleeve may receive a substantially hollow can. Solid particulates may be positioned within the can, and a substrate material or other punch may also be positioned in the can. A forming device adjacent an end of the can in which the solid particulates are located may include at least one protrusion extending into the bore. The protrusion may be adapted to deform the can while also forming the plurality of solid particulates into a solid mass having one or more reliefs and/or lobes. A method may include pressing the solid particulates while within a can to form a solid mass having one or more reliefs or lobes. An HPHT process may be performed to bond the solid mass to a substrate material.

14 Claims, 18 Drawing Sheets

(56) References Cited

U.S. PATENT DOCUMENTS

| | | | | |
|---|---|---|---|---|
| 4,190,126 | A | 2/1980 | Kabashima | |
| 4,254,840 | A | 3/1981 | Shay, Jr. | |
| 4,271,917 | A | 6/1981 | Sahley | |
| 4,334,586 | A | 6/1982 | Schumacher | |
| 4,352,400 | A | 10/1982 | Grappendorf et al. | |
| 4,511,006 | A | 4/1985 | Grainger | |
| 4,518,888 | A | 5/1985 | Zabcik | |
| 4,586,574 | A | 5/1986 | Grappendorf | |
| 4,716,977 | A | 1/1988 | Huffstutler | |
| 4,722,405 | A | 2/1988 | Langford, Jr. | |
| 4,811,801 | A | 3/1989 | Salesky et al. | |
| 4,832,139 | A | 5/1989 | Minikus et al. | |
| 4,854,405 | A | 8/1989 | Stroud | |
| 4,940,099 | A | 7/1990 | Deane et al. | |
| 4,951,762 | A | 8/1990 | Lundell | |
| D324,527 | S | 3/1992 | Slutz | |
| 5,131,478 | A | 7/1992 | Brett et al. | |
| 5,172,777 | A | 12/1992 | Siracki et al. | |
| 5,172,779 | A | 12/1992 | Siracki et al. | |
| 5,197,555 | A | 3/1993 | Estes | |
| 5,201,376 | A | 4/1993 | Williams | |
| 5,303,787 | A | 4/1994 | Brady | |
| 5,314,646 | A * | 5/1994 | Strobel | B28B 3/00 264/13 |
| 5,322,138 | A | 6/1994 | Siracki | |
| 5,323,865 | A | 6/1994 | Isbell et al. | |
| 5,341,890 | A | 8/1994 | Cawthorne et al. | |
| 5,351,768 | A | 10/1994 | Scott et al. | |
| 5,372,210 | A | 12/1994 | Harrell | |
| 5,379,854 | A | 1/1995 | Dennis | |
| 5,407,022 | A | 4/1995 | Scott et al. | |
| 5,415,244 | A | 5/1995 | Portwood | |
| 5,421,423 | A | 6/1995 | Huffstutler | |
| 5,421,424 | A | 6/1995 | Portwood et al. | |
| 5,429,199 | A | 7/1995 | Sheirer et al. | |
| 5,429,200 | A | 7/1995 | Blackman et al. | |
| 5,452,771 | A | 9/1995 | Blackman et al. | |
| 5,479,997 | A | 1/1996 | Scott et al. | |
| 5,518,077 | A | 5/1996 | Blackman et al. | |
| 5,533,582 | A | 7/1996 | Tibbitts | |
| 5,535,839 | A | 7/1996 | Brady | |
| 5,542,485 | A | 8/1996 | Pessier et al. | |
| 5,560,440 | A | 10/1996 | Tibbitts | |
| 5,592,995 | A | 1/1997 | Scott et al. | |
| 5,636,700 | A | 6/1997 | Shamburger, Jr. | |
| 5,644,956 | A | 7/1997 | Blackman et al. | |
| 5,695,019 | A | 12/1997 | Shamburger, Jr. | |
| 5,697,462 | A | 12/1997 | Grimes et al. | |
| 5,709,278 | A | 1/1998 | Crawford | |
| 5,743,346 | A | 4/1998 | Flood et al. | |
| 5,746,280 | A | 5/1998 | Scott et al. | |
| 5,752,573 | A | 5/1998 | Scott et al. | |
| 5,755,301 | A | 5/1998 | Love et al. | |
| 5,813,485 | A | 9/1998 | Portwood | |
| 5,819,861 | A | 10/1998 | Scott et al. | |
| 5,833,020 | A | 11/1998 | Portwood et al. | |
| 5,839,526 | A | 11/1998 | Cisneros et al. | |
| 5,871,060 | A | 2/1999 | Jensen et al. | |
| 5,881,828 | A | 3/1999 | Fischer et al. | |
| 5,887,655 | A | 3/1999 | Haugen et al. | |
| 5,887,668 | A | 3/1999 | Haugen et al. | |
| 5,890,550 | A | 4/1999 | Swadi et al. | |
| 5,915,486 | A | 6/1999 | Portwood et al. | |
| 5,950,745 | A | 9/1999 | Ingmarsson | |
| 5,967,245 | A | 10/1999 | Garcia et al. | |
| 6,029,759 | A | 2/2000 | Sue et al. | |
| 6,053,263 | A | 4/2000 | Meiners | |
| 6,059,054 | A | 5/2000 | Portwood et al. | |
| 6,105,693 | A | 8/2000 | Ingmarsson | |
| 6,105,694 | A | 8/2000 | Scott | |
| D430,578 | S | 9/2000 | Brady | |
| 6,135,219 | A | 10/2000 | Scott | |
| 6,161,634 | A | 12/2000 | Minikus et al. | |
| 6,176,332 | B1 | 1/2001 | Massa et al. | |
| 6,176,333 | B1 | 1/2001 | Doster | |
| 6,196,340 | B1 | 3/2001 | Jensen et al. | |
| 6,199,645 | B1 | 3/2001 | Anderson et al. | |
| 6,202,752 | B1 | 3/2001 | Kuck et al. | |
| 6,241,034 | B1 | 6/2001 | Steinke et al. | |
| 6,241,035 | B1 | 6/2001 | Portwood | |
| 6,290,008 | B1 | 9/2001 | Portwood et al. | |
| 6,367,568 | B2 | 4/2002 | Steinke et al. | |
| 6,427,791 | B1 | 8/2002 | Glowka et al. | |
| 6,510,910 | B2 | 1/2003 | Eyre et al. | |
| 6,530,441 | B1 | 3/2003 | Singh et al. | |
| 6,561,293 | B2 | 5/2003 | Minikus et al. | |
| 6,595,305 | B1 | 7/2003 | Dunn et al. | |
| 6,601,662 | B2 | 8/2003 | Matthias et al. | |
| 6,656,417 | B2 | 12/2003 | Kidowaki et al. | |
| 6,745,645 | B2 | 6/2004 | Griffo | |
| 6,782,959 | B2 | 8/2004 | Minikus et al. | |
| 6,883,624 | B2 | 4/2005 | McDonough | |
| 6,929,079 | B2 | 8/2005 | McDonough et al. | |
| 7,013,999 | B2 | 3/2006 | Tufts | |
| 7,040,424 | B2 | 5/2006 | Yong et al. | |
| 7,152,703 | B2 | 12/2006 | Meiners et al. | |
| 7,353,893 | B1 | 4/2008 | Hall et al. | |
| 7,384,105 | B2 | 6/2008 | Hall et al. | |
| 7,469,756 | B2 | 12/2008 | Hall et al. | |
| 7,631,709 | B2 | 12/2009 | McDonough et al. | |
| 7,686,106 | B2 | 3/2010 | Baker et al. | |
| 7,699,126 | B2 | 4/2010 | Boudrare et al. | |
| 7,743,855 | B2 | 6/2010 | Moss | |
| 7,757,789 | B2 | 7/2010 | Yong et al. | |
| 7,798,258 | B2 | 9/2010 | Singh et al. | |
| 7,950,476 | B2 | 5/2011 | McDonough et al. | |
| 8,028,774 | B2 | 10/2011 | Hall et al. | |
| 8,061,457 | B2 | 11/2011 | Hall et al. | |
| 8,122,980 | B2 | 2/2012 | Hall et al. | |
| 2002/0044985 | A1 | 4/2002 | Nordell et al. | |
| 2002/0108789 | A1 | 8/2002 | Schautt | |
| 2003/0034179 | A1 | 2/2003 | Singh | |
| 2004/0163851 | A1 | 8/2004 | McDonough et al. | |
| 2004/0173384 | A1 | 9/2004 | Yong et al. | |
| 2005/0023043 | A1 | 2/2005 | Tufts | |
| 2005/0247492 | A1 | 11/2005 | Shen et al. | |
| 2007/0095577 | A1 | 5/2007 | Griffo et al. | |
| 2007/0144790 | A1* | 6/2007 | Fang | C01B 31/06 175/434 |
| 2008/0035387 | A1 | 2/2008 | Hall et al. | |
| 2008/0060852 | A1 | 3/2008 | Chandila et al. | |
| 2008/0156542 | A1 | 7/2008 | Baker et al. | |
| 2008/0156543 | A1 | 7/2008 | McDonough et al. | |
| 2010/0059286 | A1 | 3/2010 | McDonough et al. | |
| 2010/0059287 | A1 | 3/2010 | Durairajan | |
| 2010/0104874 | A1* | 4/2010 | Yong | C22C 26/00 428/408 |
| 2010/0320006 | A1* | 12/2010 | Fan | B24D 99/005 175/428 |
| 2011/0036643 | A1* | 2/2011 | Belnap | C22C 26/00 175/434 |
| 2011/0042147 | A1* | 2/2011 | Fang | B22F 7/08 175/426 |
| 2011/0259642 | A1 | 10/2011 | Digiovanni et al. | |
| 2012/0100033 | A1* | 4/2012 | Voice | B22F 3/1216 419/49 |
| 2012/0211284 | A1 | 8/2012 | Digiovanni | |

FOREIGN PATENT DOCUMENTS

| | | | |
|---|---|---|---|
| EP | 0446765 | B1 | 4/1995 |
| EP | 0391683 | B1 | 1/1996 |
| EP | 0527506 | B1 | 2/2000 |
| FR | 2620487 | A | 3/1989 |
| GB | 2361497 | A | 10/2001 |
| GB | 2369841 | A | 6/2002 |
| GB | 2393982 | A | 4/2004 |
| GB | 2398330 | A | 8/2004 |
| JP | 01205003 | A | 8/1989 |
| RU | 2105124 | C1 | 2/1998 |
| RU | 2153569 | C2 | 7/2000 |
| WO | 0161142 | A1 | 8/2001 |

* cited by examiner

2004

MANUFACTURE OF CUTTING ELEMENTS HAVING LOBES

CROSS-REFERENCE TO RELATED APPLICATIONS

This application claims the benefit of U.S. Provisional Patent Application Ser. No. 61/746,758, filed Dec. 28, 2012, and entitled "Cutting Element for Percussion Drill Bit," which application is expressly incorporated herein by this reference in its entirety.

BACKGROUND

In drilling a wellbore in a subterranean formation, such as for the recovery of hydrocarbons, a drill bit is connected to the lower end of a drill string that includes a plurality of drill pipe sections connected end-to-end. The drill bit is rotated by rotating the drill string at the surface and/or by actuation of downhole motors or turbines. With weight applied to the bit from the drill string, the rotating drill bit engages the formation causing the drill bit to cut through the subterranean formation by either abrasion, fracturing, or shearing action, thereby forming the wellbore.

Several types of drill bits are used in drilling operations, and may include percussion hammer bits, roller cone bits, fixed cutter bits, and drag bits. In drilling operations using percussion hammer bits, the drill bit is mounted to the lower end of the drill string, and the drill string moves the drill bit back and forth axially to impact the formation to crush, break, and loosen formation material. To facilitate such effect, multiple inserts or cutting elements may be disposed on a face of the drill bit to impact the formation and crush, break, and loosen the formation material. In order to promote efficient penetration, the percussion hammer drill bit is "indexed" so that the cutting elements contact fresh formations for each subsequent impact. Indexing is achieved by rotating the percussion hammer drill bit a slight amount between each axial impact of the bit with the formation. In such operations, the mechanism for penetrating the formation is of an impacting nature, rather than shearing nature. The impacting and rotating percussion hammer drill bit engages the formation and proceeds to form the wellbore along a predetermined path toward a target zone.

SUMMARY

In accordance with some embodiments of the present disclosure a method for forming a cutting insert is disclosed. The illustrative method may include inserting solid particulates and a substrate material into a substantially hollow can. The substrate material may include a base portion and an extension portion. The substantially hollow can, substrate material, and solid particulates may be inserted into a bore of a sleeve, and the substantially hollow can may be engaged against a forming device having at least one protrusion. A force may be applied to the substrate material within the substantially hollow can to deform the substantially hollow can while the solid particulates are therein.

In another embodiment, an apparatus for forming a cutting insert is disclosed in accordance with some aspects of the present disclosure. The apparatus may include a sleeve having a bore therein. The sleeve may be arranged and designed to receive a substantially hollow can and solid particulates within the substantially hollow can. A forming device may be located at a first end portion of the bore and can include at least one protrusion extending into the bore. The protrusion may be arranged and designed to deform the can while the solid particulates are therein. In some embodiments, the protrusion may deform the can and substrate material, and form a layer of solid particulates on the deformed substrate material, during a single compressive cycle.

In another embodiment, a method for forming a cutting insert may include inserting diamond particles into a deformable can. A punch may be inserted into the deformable can such that the diamond particles are between the punch and an interior surface of the can. The punch, can, and diamond particles may be inserted wholly or partially into a compression device, and a compressive force may be applied to the punch to cause a protrusion of the compression device to deform the can and the punch such that a relief is formed in a deformed portion of the punch, and the plurality of diamond particles form a substantially solid layer. In some embodiments, the substantially solid layer may be press-fit to a deformed portion of the punch. In some additional embodiments, the punch may be a carbide substrate material.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In order to describe various features and concepts of the present disclosure, a more particular description of certain subject matter will be rendered by reference to specific embodiments which are illustrated in the appended drawings. These drawings depict example embodiments which are to scale for some, but are not drawn to scale for each possible embodiment. The drawings are not to be considered to be limiting in scope.

FIG. 8-1 is a perspective view of another illustrative cutting element having three lobes, according to one or more embodiments of the present disclosure.

FIG. 8-2 is a perspective view of another illustrative cutting element having three lobes, according to one or more embodiments of the present disclosure.

FIGS. 11-1 and 11-2 are perspective and cross-sectional views, respectively, of an illustrative cutting element, according to one or more embodiments of the present disclosure.

FIGS. 12-1 and 12-2 are perspective and cross-sectional views, respectively, of another illustrative cutting element, according to one or more embodiments of the present disclosure.

FIGS. 14-1 and 14-2 are perspective and cross-sectional views, respectively, of another illustrative cutting element, according to one or more embodiments of the present disclosure.

FIGS. 15-1 and 15-2 are cross-sectional and perspective views, respectively, of another illustrative cutting element, according to one or more embodiments of the present disclosure.

FIGS. 16-1 and 16-2 are cross-sectional and perspective views, respectively, of another illustrative cutting element, according to one or more embodiments of the present disclosure.

FIG. 19-1 depicts a bit face of a percussion drill bit having a plurality of cutting elements coupled thereto, according to one or more embodiments of the present disclosure.

FIG. 19-2 depicts a subterranean formation having a plurality of cracks formed therein after being contacted by the bit face shown in FIG. 19-1, according to one or more embodiments of the present disclosure.

FIG. 20-1 depicts a bit face of a percussion drill bit having a plurality of cutting elements coupled thereto, according to one or more embodiments of the present disclosure.

FIG. 20-2 depicts a subterranean formation having a plurality of cracks formed therein after being contacted three times with the bit face shown in FIG. 20-1, according to one or more embodiments of the present disclosure.

FIG. 20-3 depicts another subterranean formation having a plurality of cracks formed therein after being contacted three times with the bit face shown in FIG. 20-1, according to one or more embodiments of the present disclosure.

DETAILED DESCRIPTION

Embodiments disclosed herein generally relate to bits. More specifically, embodiments disclosed herein may relate to cutting inserts for percussion hammer bits. More particularly still, embodiments disclosed herein may relate to cutting inserts having multiple lobes and which may be used in percussion hammer bits, and methods for manufacturing cutting inserts having multiple lobes.

Figure 1:
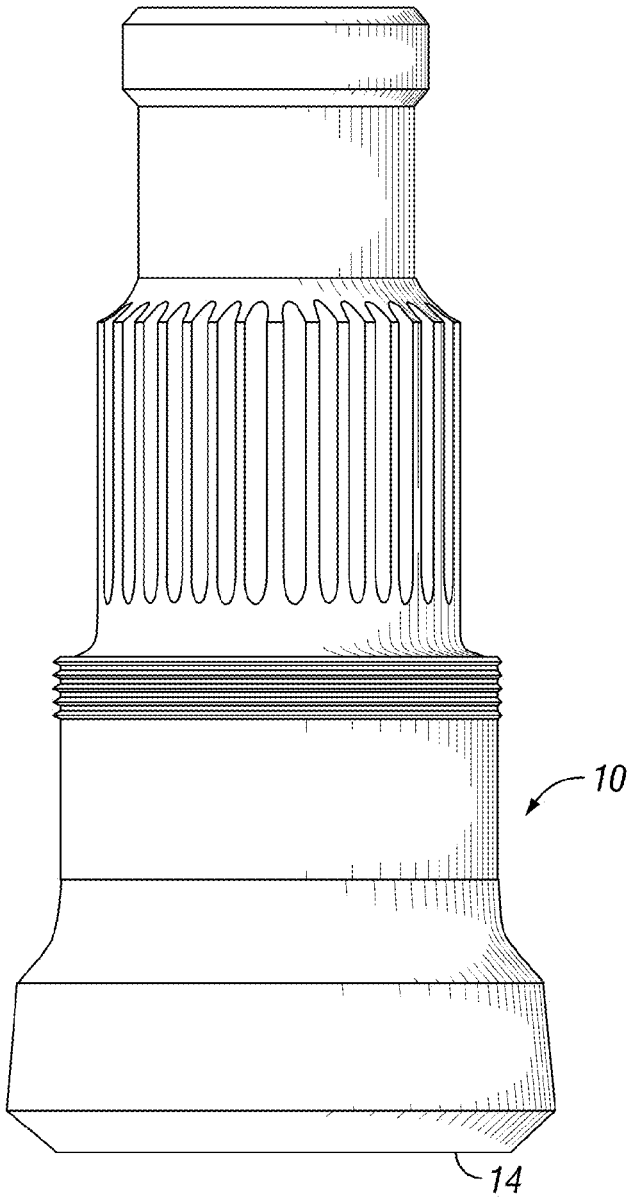
FIG. 1 is a side view of an illustrative percussion hammer drill bit, according to one or more embodiments of the present disclosure.

FIG. 1 depicts a side view of an illustrative percussion hammer bit 10 having a bit face 14 for impacting and breaking up a formation. An example of the bit face 14 is further illustrated in FIG. 2 which depicts the bit face 14 of the percussion hammer bit 10 having a plurality of cutting inserts 100 coupled thereto. Any number of cutting inserts 100 may be coupled to, or otherwise disposed on, the bit face 14, and the cutting inserts 100 may be arranged in any number of manners, configurations, patterns, and the like. Moreover, the cutting inserts 100 themselves may have any number of different shapes, forms, constructions, or other characteristics.

Figure 2:
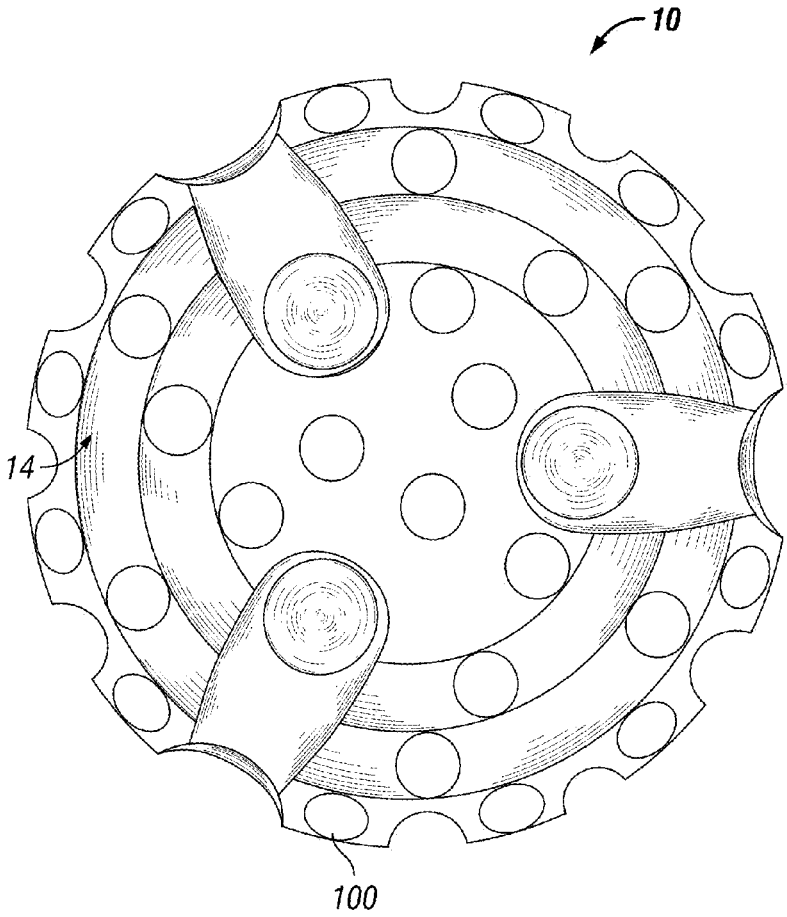
FIG. 2 is a bottom view of a bit face of the percussion hammer drill bit including a plurality of cutting elements, according to one or more embodiments of the present disclosure.
Figure 3:
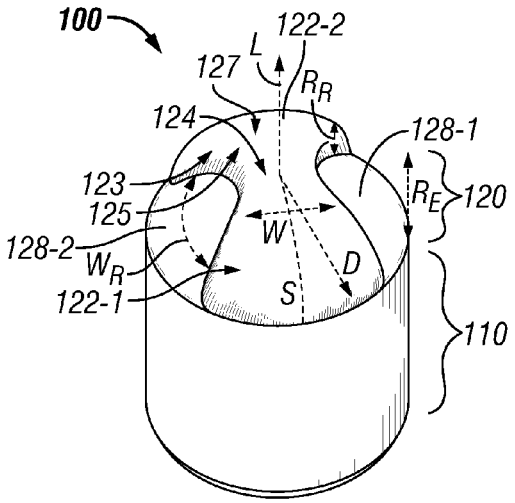
FIG. 3 is a perspective view of a cutting element, according to one or more embodiments of the present disclosure.

An example of a cutting insert that may be used in connection with the percussion hammer bit 10 of FIGS. 1 and 2 is shown in FIG. 3, which provides a perspective view of an illustrative cutting insert 100, according to one embodiment disclosed herein. The cutting insert 100 may include a base portion 110 coupled to an extension portion 120. A longitudinal axis L may extend through one or both of the base portion 110 or the extension portion 120. As shown, the base portion 110 may be cylindrical in some embodiments. With continued reference to FIGS. 1-3, the base portion 110 may be coupled to the bit face 14 of the bit 10. In some embodiments, the extension portion 120 may be integral with the base portion 110 and at least partially axially offset therefrom.

The extension portion 120 may include at least two lobes 122-1, 122-2 in some embodiments. The lobes 122-1, 122-2 may be integral with one another proximate the longitudinal axis L, and may extend radially outward therefrom. The lobes 122-1, 122-2 of the cutting insert 100 may have a radial length D (as measured from the longitudinal axis L) and a width W (as measured from opposing side walls 123 of the lobes 122-1, 122-2 and in a plane generally perpendicular to the longitudinal axis L, or in a plane tangential to the lobes 122-1, 122-2). The radial length D of the lobes 122-1, 122-2 may be less than or substantially equal to a radius of the base 110, the extension portion 120, or the cutting insert 100. In some embodiments, the radial length D of the lobes 122-1, 122-2 may be greater than the radius of the base 110.

The width W of the lobes 122-1, 122-2 may increase, decrease, or remain substantially the same moving outward from the longitudinal axis L along the radial distance D. As shown in FIG. 3, the width W may increase as the radial distance from the longitudinal axis L increases, such that the width W may be greater proximate the outer radial edge of lobes 122-1, 122-2 than proximate the longitudinal axis L. In other embodiments, the greatest width W may be located at or near the longitudinal axis L, or at a radial position of the lobes 122-1, 122-2 that is between the longitudinal axis L and the outer radial edge of the lobes 122-1, 122-2.

The lobes 122-1, 122-2 may be circumferentially offset from one another around the longitudinal axis L by one or more angles that may range from about 25° to about 240° in some embodiments. For instance, the circumferential offset, or angle, between the lobes 122-1, 122 may range from about 30°, about 45°, about 60°, or about 75° to about 90°, about 120°, about 150°, about 180°, about 200°, or more. For example, the angle between center-lines of adjacent lobes 122-1, 122-2 may be between about 50° and about 90°, between about 70° and about 110°, between about 100° and about 140°, or between about 160° and about 200°. As shown, the lobes 122-1, 122-2 in FIG. 3 are circumferentially offset from one another by about 180°. In other embodiments, an angle between the lobes 122-1, 122-2 may be less than about 25° or greater than about 240°.

A void or relief 128-1, 128-2 may be disposed between adjacent lobes 122-1, 122-2. The reliefs 128-1, 128-2 may continue for an angle $W_R$ around the extension portion 120, and between the sides 123 of the lobes 122-1, 122-2. The angle $W_R$ may range from about 10° to about 180° in some embodiments. More particularly, the angle $W_R$ may range from about 15°, about 25°, about 30°, about 40°, about 50°, or about 60° to about 75°, about 90°, about 120°, about 150°, or more. For example, the angle $W_R$ may be between about 20° and about 40°, about 40° and about 60°, between about 60° and about 80°, between about 80° and about 100°, between about 100° and about 120°, or between about 120° and about 140°. In other embodiments, the angle $W_R$ may be less than about 30° or greater than about 150°.

A height of the outer axial surface of the extension portion 120 proximate the reliefs 128-1, 128-2 may, in some embodiments, vary with respect to the base portion 110. As shown, the height of the outer axial surface of extension portion 120 proximate the reliefs 128-1, 128-2 may increase moving radially inward. In other words, the height may be greater proximate the longitudinal axis L of the cutting insert 100 than proximate the outer radial edge.

The lobes 122-1, 122-2 may extend axially away from the base portion 110. An outer axial surface 127 (which may also be a top surface in the orientation shown in FIG. 3) of the lobes 122-1, 122-2 may therefore be offset from an outer axial surface of the extension portion 120 proximate the reliefs 128-1, 128-2 by a distance/height $R_R$. The height $R_R$ of the outer axial surface 127 of the lobes 122-1, 122-2 may increase, decrease, or remain substantially constant along the radial length D and/or the width W of the lobes 122-1, 122-2 with respect to the base portion 110. In some embodiments, the height of the outer axial surface 127, and thus the thickness of the lobes 122-1, 122-2, may be generally constant moving outwardly from the longitudinal axis L along at least a portion of the radial distance D. In some embodiments, the outer axial surface 127 and/or an outer axial surface of the extension portion within the reliefs 128-1, 128-2 may be convexly or concavely curved, while in other embodiments, the outer axial surface of the extension portion 120 proximate the reliefs 128-1, 128-2 may include a surface of the base portion 110. In some embodiments, and as shown in FIG. 3, the height $R_R$ of the outer axial surface 127 of the lobes 122-1, 122-2 may gradually decrease proximate the outer radial edge of the lobes 122-1, 122-2, although the height $R_R$ may vary in any number of manners along the radial distance D of the lobes 122-1, 122-2.

For instance, in another embodiment, the height $R_R$ of the outer axial surface 127 of the lobes 122-1, 122-2 may increase moving inwardly toward the longitudinal axis L along the radial distance D. In other words, the height of the outer axial surface 127 of the lobes 122-1, 122-2 may be greater proximate the longitudinal axis L of the cutting insert 100 than proximate the outer radial edge of the extension portion 120. As such, a crest portion 124 may be formed on the outer axial surface 127 of the lobes 122-1, 122-2 proximate the longitudinal axis L. The axial distance between the outer axial surface 127 of the lobes 122-1, 122-2 proximate the longitudinal axis (e.g., at the crest portion 124) and the outer axial surface 127 of the lobes 122-1, 122-2 proximate the outer radial edge may range from about 0.25 mm to about 12 mm in some embodiments. For instance, such an axial distance may range from about 0.5 mm, about 1 mm, about 2 mm, about 3 mm, or about 4 mm to about 5 mm, about 6 mm, about 8 mm, about 10 mm, or more. For example, the axial distance may be between about 0.5 mm and about 2 mm, between about 1 mm and about 3 mm, between about 2 mm and about 4 mm, or between about 3 mm and about 8 mm. In other embodiments, the axial distance may be less than about 0.25 mm or greater than about 12 mm.

As used herein, "crest portion" is used to refer to one or more portions of the lobes (e.g., lobes 122-1, 122-2) of an extension portion having an outer axial surface that is farthest from the base portion (i.e., a tip or apex). A crest portion (e.g., crest portion 124) may act as a cutting portion or contact portion of the cutting insert 100. In FIG. 3, the distance between the base portion 110 and the crest portion 124 is represented by $R_E$, which may also represent a maximum thickness or height of the extension portion 120 and/or lobes 122-1, 122-2.

The height of the outer axial surface 127 of the lobes 122-1, 122-2 may be substantially constant along at least a portion of the width W, while an interface or intersection 125 between the outer axial surface 127 and the sides 123 may be chamfered, beveled, or tapered. In some embodiments, a plane of symmetry S may extend through each lobe 122-1, 122-2 such that the side surfaces 123 of a particular lobe may be mirror images of one another. In another embodiment, however, the lobes 122-1, 122-2 may not be symmetrical.

Figure 4:
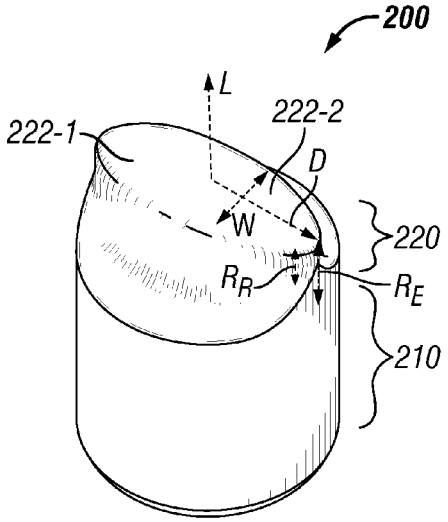
FIG. 4 is a perspective view of another cutting element, according to one or more additional embodiments of the present disclosure.

FIG. 4 is a perspective view of another illustrative cutting insert 200, according to one or more embodiments of the present disclosure. The cutting insert 200 has a base portion 210 and an extension portion 220 extending axially from the base portion 210. The extension portion 220 may include two lobes 222-1, 222-2 which may intersect at or near a longitudinal axis L. The lobes 222-1, 222-2 may be generally similar to the lobes 122-1, 122-2 described above with reference to FIG. 3; however, the width W of the lobes 222-1, 222-2 in FIG. 4 may decrease moving radially outward from the longitudinal axis L along the radial distance D. In some embodiments, the lobes 222-1, 222-2 may at their widest points have a width W less than about 10 mm, less than about 7 mm, less than about 5 mm, less than about 4 mm, less than about 3 mm, less than about 2 mm, less than about 1 mm, less that about 0.5 mm, or less than about 0.25 mm (e.g., proximate the longitudinal axis L in FIG. 4). When the lobes 222-1, 222-2 have a relatively smaller width W, the surface area of the lobes 222-1, 222-2 contacting the formation may be reduced, thereby concentrating an impact force when the cutting insert 200 is used in connection with a percussion hammer bit.

As shown, a height $R_R$ of the lobes 222-1, 222-2 may gradually change along the radial distance D. For instance, the height $R_R$ of the lobes 222-1, 222-2 may increase moving outwardly from the longitudinal axis L along the radial distance D. However, in other embodiments, the height $R_R$ of the lobes 222-1, 222-2 may gradually decrease moving outwardly from the longitudinal axis L along the radial distance D. In still other embodiments, the height $R_R$ of the lobes 222-1, 222-2 may increase and then decrease (or vice versa) moving outwardly from the longitudinal axis L along the radial distance D. Further, the height $R_R$ of the lobes 222-1, 222-2 may be designed with respect to the width W of the lobes 222-1, 222-2. In at least one embodiment, a ratio between the height $R_R$ of the lobes 222-1, 222-2 and the width W of the lobes 222-1, 222-2 may be less than about 5:1, less than about 3:1, less than about 2.5:1, less than about 2:1, less than about 1.5:1 less than about 1:1, or less than about 0.5:1.

Figure 5:
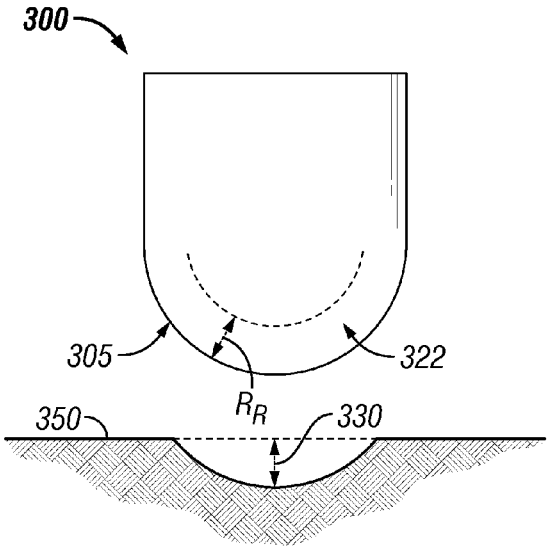
FIG. 5 is a side view of a cutting element following engagement with a formation, according to one or more embodiments of the present disclosure.

FIG. 5 is a side view cutting profile 305 of an illustrative cutting insert 300 for contacting a subterranean formation 350, according to one or more embodiments of the present disclosure. A cutting depth 330 in the formation 350 may generally correspond to the height $R_R$ of the lobes 322 in some embodiments. In some embodiments, the height $R_R$ of one or more lobes 322 may range from about 0.25 mm, about 0.5 mm, about 0.75 mm, or about 1.0 mm to about 1.25 mm, about 1.5 mm, about 2.0 mm, about 3.0 mm, or more. For example, the height $R_R$ of the lobes 322 may be between about 0.25 mm and about 0.75 mm, between about 0.5 mm and about 1.0 mm, or between about 0.75 mm and about 1.5 mm. In other embodiments, the height $R_R$ of the lobes 322 may be less than about 0.25 mm or greater than about 3 mm.

The cutting depth 330 of the cutting insert 300 may refer to the depth within the formation 350 impacted or removed with each hammer, or blow, of the bit (see bit 10 of FIG. 1), as measured after the bit impacts the formation 350. In some embodiments, the cutting depth 330 may be less than the height $R_R$ of the lobe 322. In at least one embodiment, the height $R_R$ of the lobe 322 may be about two times the cutting depth 330. The cutting depth 330 may range in value depending on, for example, the formation 350 being drilled and the impact force applied by the bit. In some environments, after a single blow by the bit, the cutting insert 300 may generate a cutting depth 330 ranging from about 0.05 mm, about 0.1 mm, about 0.25 mm, or about 0.5 mm to about 0.75 mm, about 1 mm, about 1.5 mm, about 2 mm, or more. For example, the cutting depth 330 may be between about 0.05 mm and about 0.5 mm, between about 0.05 mm and about 0.25 mm, or between about 0.1 mm and about 0.75 mm. The cutting depth 330 may also be less than about 0.05 mm or greater than about 2 mm in some embodiments.

Figure 6:
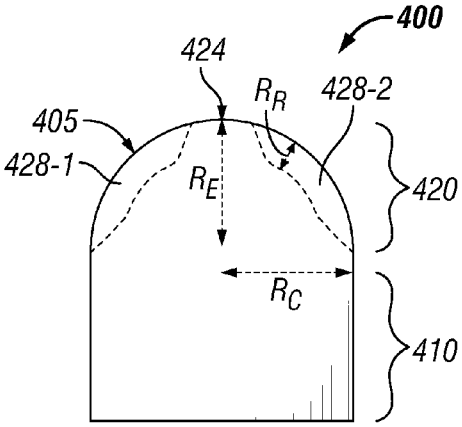
FIG. 6 is a side view of an illustrative cutting element, according to one or more embodiments of the present disclosure.

FIG. 6 illustrates a cutting profile 405 of a cutting insert 400, according to one or more embodiments. As shown, the cutting profile 405 may have the cross-sectional shape of the cutting insert 400 without inclusion of at least some of the cutting surface geometry. Thus, the shape of the cutting profile 405 may not include reliefs formed between lobes in the extension portion 420.

As shown in FIG. 6, the cutting insert 400 may include a base portion 410 and an extension portion 420. An outer surface of the extension portion 420 may have a dome or partially spherical shape; however, in other embodiments, the outer surface of the extension portion 420 may have a conical, frustoconical, or other shape, or some combination of the foregoing. In the illustrated embodiment, the extension portion 420 may have at least two reliefs 428-1, 428-2, and the outer axial surface of the extension portion 420 proximate the reliefs 428-1, 428-2 may be offset from the outer surface of an adjacent lobe by a distance/height $R_R$. The profiles of the reliefs 428-1, 428-2 are shown in FIG. 6 using dashed lines to represent the bases or outer surfaces of the reliefs 428-1, 428-2.

The height $R_E$ from the base portion 410 to the crest portion 424 may be defined in relation to a radius of the base portion $R_C$. A ratio of the height $R_E$ to the radius of the base portion $R_C$ may be less than or equal to about 1:1, about 0.9:1, about 0.8:1, about 0.7:1, about 0.6:1, or about 0.5:1. For example, the ratio of the height $R_E$ to the radius of the base portion $R_C$ may be between about 0.5:1 and about 1:1, between about 0.6:1 and about 0.9:1, or between about 0.7:1 and about 0.8:1. In other embodiments, the ratio of the height $R_E$ to the radius of the base portion $R_C$ may be greater than about 1:1 or less than about 0.5:1.

Figure 7:
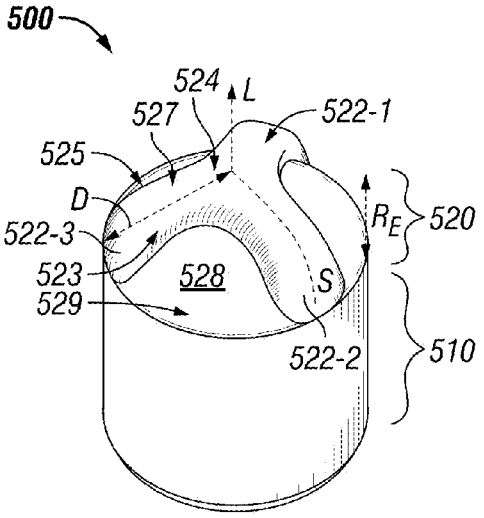
FIG. 7 is a perspective view of an illustrative cutting element having three lobes, according to one or more embodiments of the present disclosure.

FIG. 7 is a perspective view of an illustrative cutting insert 500 having three lobes 522-1, 522-2, 522-3, according to one or more embodiments. As shown, the lobes 522-1, 522-2, 522-3 may be circumferentially offset from one another by about 120° around the longitudinal axis L; however, this is merely illustrative and the lobes 522-1, 522-2, 522-3 may be circumferentially offset at unequal angular intervals in other embodiments. The lobes 522-1, 522-2, 522-3 may intersect with one another at or near a longitudinal axis L, which may also include a crest portion 524 in some embodiments. Optionally, the crest portion 524 may be relatively flat when compared with the curvature of the remaining portions of the extension portion 520. For example, the crest portion 524 may form a plane about perpendicular to the longitudinal axis L. However, in other embodiments, the crest portion 524 may have a concave, convex, angled, or other type of surface relative to the longitudinal axis L and/or the base portion 510.

Each lobe 522-1, 522-2, 522-3 may include two opposing side surfaces 523, as well as an outer axial surface 527. Each side surface 523 may interface or intersect the outer axial surface 527 at a junction such as intersection 525. The side surfaces 523 optionally minor each other, such that a plane of symmetry S may extend along a radial distance D of each lobe 522-1, 522-2, 522-3 from the crest portion 524 to the outer radial edge of the extension portion 520.

A relief 528 may be formed between each adjacent set of lobes 522-1, 522-2, 522-3. The extension portion 520 may have an outer axial surface 529 proximate the relief 528,— and potentially exposed therein. The outer axial surface 529 and the relief 528 may be bordered by the side surfaces 523 of adjacent lobes 522-1, 522-2, 522-3. The side surfaces 523 may intersect with the outer axial surface 529 at an angle. The side surfaces 523 may be substantially perpendicular relative to the outer axial surface 529, although the side surfaces 523 may intersect with the outer axial surface 529 at an angle that is less than about 90° or greater than about 90° in other embodiments. As with the intersection between the side surfaces 523 and the outer axial surface 527 of the lobes 522-1, 522-2, 522-3, intersection angles may be measured without taking into account any curved, beveled, or other transition surface.

The axial height difference of the outer axial surface 527 from an uppermost to a lower most position (e.g., from the crest portion 524 to a position proximate the outer radial edge of the extension portion 520 in FIG. 7) may range, in some embodiments, from about 0.5 mm, about 1 mm, about 2 mm, about 3 mm, or about 4 mm to about 5 mm, about 6 mm, about 8 mm, about 10 mm, or more. For example, the axial height difference may be between about 0.5 mm and about 2 mm, between about 1 mm and about 3 mm, between about 2 mm and about 4 mm, or between about 3 mm and about 8 mm. In other embodiments, the axial height difference may be less than about 0.5 mm or greater than about 10 mm.

Figures 1, 8:
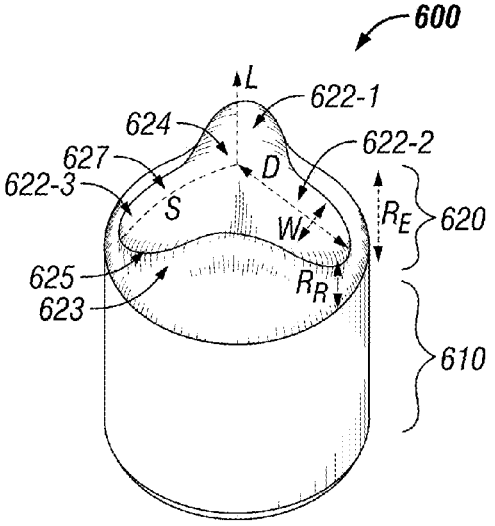
Figures 2, 8:
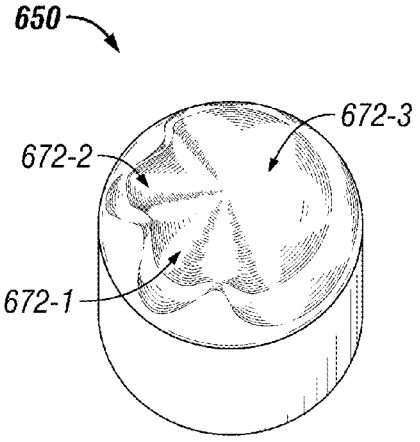

FIG. 8-1 is a perspective view of another illustrative cutting insert 600 having three lobes 622-1, 622-2, 622-3, according to one or more embodiments. As shown, the lobes 622-1, 622-2, 622-3 may be circumferentially offset from one another (e.g., by about 120° around the longitudinal axis L). While the lobes 522-1, 522-2, 522-3 in FIG. 7 are each shown as having a generally constant width W along the radial length D thereof, the width W of the lobes 622-1, 622-2, 622-3 in FIG. 8-1 may vary moving outwardly from the longitudinal axis L along the radial distance D. More particularly, the width W of the lobes 622-1, 622-2, 622-3 may decrease moving outwardly from the longitudinal axis L along the radial distance D.

Further, each lobe 622-1, 622-2, 622-3 may have two opposing side surfaces 623, and an outer axial surface 627, with each side surface 623 intersecting the outer axial surface 627 at an intersection 625. The side surfaces 623 may mirror each other, such that a plane of symmetry S may extend along a radial distance D of each lobe 622-1, 622-2, 622-3, from the longitudinal axis L to the outer radial edge of the extension portion 620. Additionally, each lobe 622-1, 622-2, 622-3 may extend a height $R_R$ that is the distance from the base portion 610 (or the outer radial surface of the base portion 610) to the outer axial surface 627 of the lobes 622-1, 622-2, 622-3. The height $R_R$ may vary along the radial distance D and/or along the width W of the lobes 622-1, 622-2, 622-3.

The change in elevation of the outer axial surface 627 of the lobes 622-1, 622-2, 622-3 between a crest portion 624 (e.g., proximate the longitudinal axis L) and at a minimum elevation (e.g., proximate the outer radial edge of the extension portion 630) may range from about 0.5 mm, about 1 mm, about 2 mm, about 3 mm, or about 4 mm to about 5 mm, about 6 mm, about 8 mm, about 10 mm, or more. For example, the change in height or elevation distance may be between about 0.5 mm and about 2 mm, between about 1 mm and about 3 mm, between about 2 mm and about 4 mm, or between about 3 mm and about 8 mm.

As further shown in FIG. 8-1, the side surfaces 623 of the lobes 622-1, 622-2, 622-3 may transition into the extension portion 620 at a location axially offset from the base portion 610. In the same or other embodiments, the side surfaces 623 of the lobes 622-1, 622-2, 622-3 may transition into the extension portion 620 at a location axially aligned with the base portion 610. For instance, FIG. 7 illustrates the side surfaces 523 of the lobes 522-1, 522-2, 522-3 transitioning into the base portion 510.

FIG. 8-2 is a perspective view of another illustrative cutting insert 650 having three lobes 672-1, 672-2, 672-3, according to one or more embodiments. Each of the lobes 672-1, 672-2, 672-3 may extend around a portion of the circumference of the cutting insert 650. The lobes 672-1, 672-2, 672-3 may each extend from about 10°, about 20°, about 30°, about 45°, or about 60° to about 90°, about 120°, about 150°, about 180°, about 210°, or more of the circumference of the cutting insert 650. For example, one or more of the lobes 672-1, 672-2, 672-3 may each extend around the circumference of the cutting insert 650 between about 10° and about 30°, between about 30° and about 60°, between about 60° and about 90°, between about 90° and about 120°, between about 120° and about 150°, between about 150° and about 180°, or between about 180° and about 210°.

One or more lobes (e.g., lobe 672-3) may extend around a greater or lesser portion of the circumference of the cutting insert 650 than another lobe (e.g., lobes 672-1, 672-2). As shown, the first and second lobes 672-1 and 672-2 may illustratively extend around the circumference of the cutting insert 650 between about 10° and about 45°, while the third lobe 672-3 may extend around between about 180° and about 210° of the circumference of the cutting insert 650. As should be appreciated by a person having ordinary skill in the art in view of the disclosure herein, the cutting insert 650 may include any number of lobes ranging from a low of about 1, about 2, or about 3 to a high of about 4, about 6, about 8, about 10, or about 15, and any one or more of the lobes may extend around a greater or lesser portion of the circumference of the cutting insert 650 relative to other lobes. Moreover, where the lobes 672-1, 672-2, 672-3 may have different widths, the circumferential offsets between the lobes 672-1, 672-2, 672-3 as measured from the central axis of each lobe 672-1, 672-2, 672-3 may optionally vary.

Figure 9:
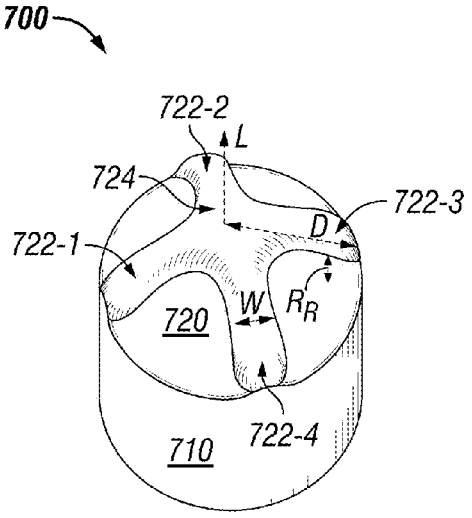
FIG. 9 is a perspective view of an illustrative cutting element having four lobes, according to one or more embodiments of the present disclosure.
Figure 10:
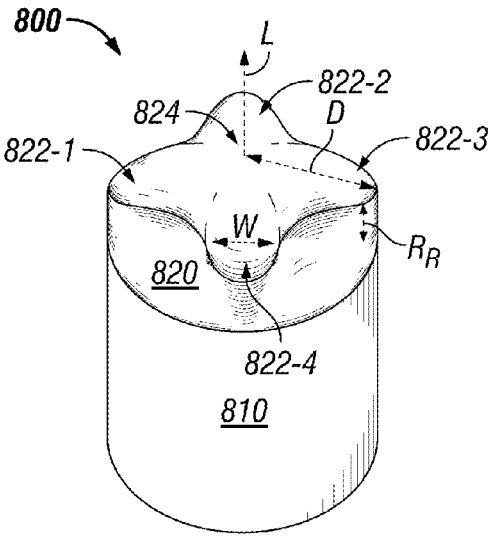
FIG. 10 is a perspective view of another illustrative cutting element having four lobes, according to one or more embodiments of the present disclosure.

FIG. 9 is a perspective view of an illustrative cutting insert 700 having four lobes 722-1, 722-2, 722-3, 722-4, and FIG. 10 is a perspective view of another illustrative cutting insert 800 having four lobes 822-1, 822-2, 822-3, 822-4, according to one or more embodiments of the present disclosure. The lobes 722-1, 722-2, 722-3, 722-4 of cutting insert 700, and the lobes 822-1, 822-2, 822-3, 822-4 of cutting insert 800, may optionally intersect to form a substantially flat crest portion 724, 824. In other words, the surface of the crest portion 724, 824 may be generally planar, and optionally substantially perpendicular to the longitudinal axis L. The crest portions 724, 824 may transition into the outer axial surfaces of the respective lobes 722-1, 722-2, 722-3, 722-4, 822-1, 822-2, 822-3, 822-4. According to other embodiments, however, the crest portions 724, 824 may have a concave or convex surface in relation to the base portion 710, 810 of the cutting insert 700, 800, or may be located at locations other than an intersection of the respective lobes 722-1, 722-2, 722-3, 722-4, 822-1, 822-2, 822-3, 822-4 (e.g., along the length D of one or more lobes).

The width of the lobes 722-1, 722-2, 722-3, 722-4 on the cutting insert 700 may be substantially the same moving radially outwardly from the longitudinal axis L. The width of the lobes 822-1, 822-2, 822-3, 822-4 on the cutting insert 800 may decrease moving radially outwardly from the longitudinal axis L. In other embodiments, the width of the lobes of a cutting insert may increase moving radially outwardly and/or increase and then decrease (or vice versa) moving radially outwardly from the longitudinal axis. As further shown in FIG. 9, the side surfaces of the lobes 722-1, 722-2, 722-3, 722-4 may transition into the extension portion 720 at a location axially aligned with the base portion 710. In FIG. 10, however, the side surfaces of the lobes 822-1, 822-2, 822-3, 822-4 may transition into the extension portion 820 at a location axially offset from the base portion 810. The lobes 722-1, 722-2, 722-3, 722-4 are thus shown as having a relatively more abrupt transition from the extension portion 720 as compared to the lobes 822-1, 822-2, 822-3, 822-4 relative to the extension portion 820.

Figures 1, 11:
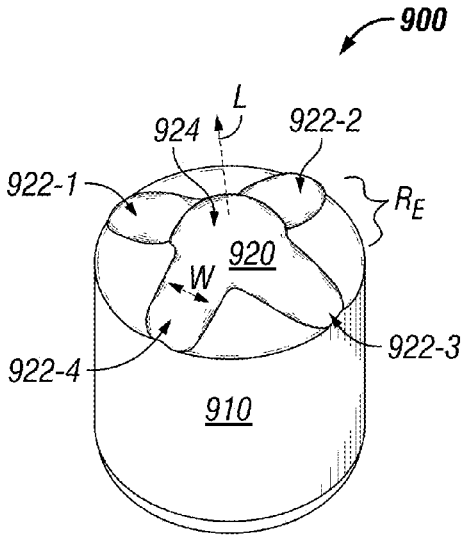
Figures 2, 11:
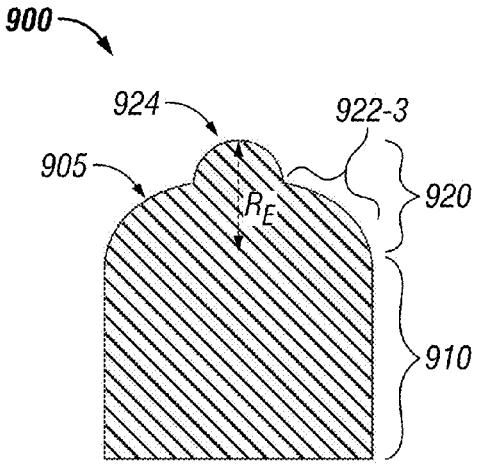

FIGS. 11-1 and 11-2 depict perspective and cross-sectional views, respectively, of an illustrative cutting insert 900 having a cutting profile 905 according to one or more embodiments. The cutting insert 900 may have a base portion 910, and an extension portion 920 extending a distance $R_E$ from the base portion 910 along a longitudinal axis L. The extension portion 920 may also include a plurality of lobes 922-1, 922-2, 922-3, 922-4 intersecting at the crest portion 924. As shown in FIGS.

11-1 and 11-2, the crest portion 924 of the cutting insert 900 may have an outer axial surface that is convex with respect to the base portion 910.

In the illustrated embodiment, the outer axial surfaces, or top surfaces, of the lobes 922-1, 922-2, 922-3, 922-4 may extend generally downwardly from the crest portion 924 toward the base portion 910 when moving radially outwardly from the longitudinal axis L. In some embodiments, the profile of the crest portion 924 may form a low-profile or blunt dome. By configuring the extension portion 920 of the cutting insert 900 to have both a relatively low distance/height $R_E$ and a crest portion 924 forming a central tip, the cutting insert 900 may be utilized as if having a blunt profile and sharp profile at the same time. For example, the low cross-sectional area of the crest portion 924 may act as a sharp tip for penetrating a formation without causing torque issues, while the blunt characteristics of the remainder of the lobes 922-1, 922-2, 922-3, 922-4 may reduce the force used to remove parts of the formation.

Figures 1, 12:
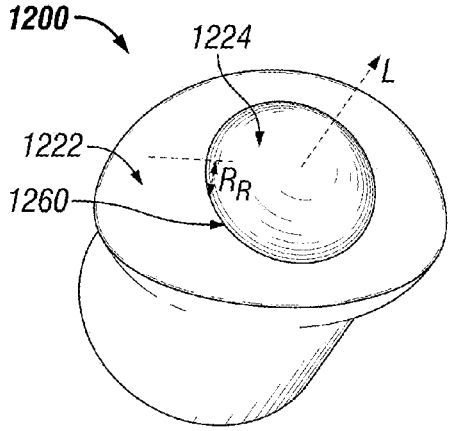
Figures 2, 12:
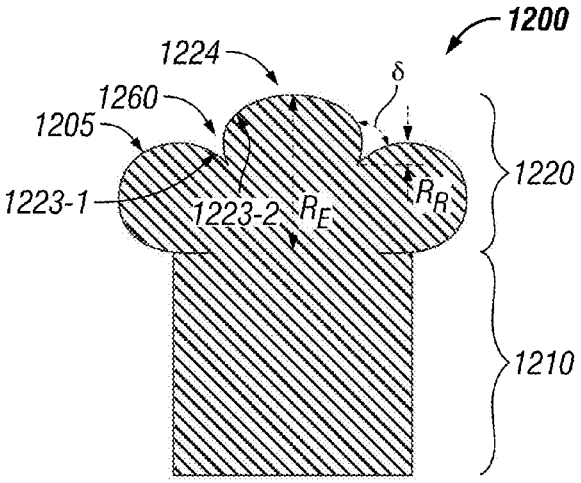
Figure 13:
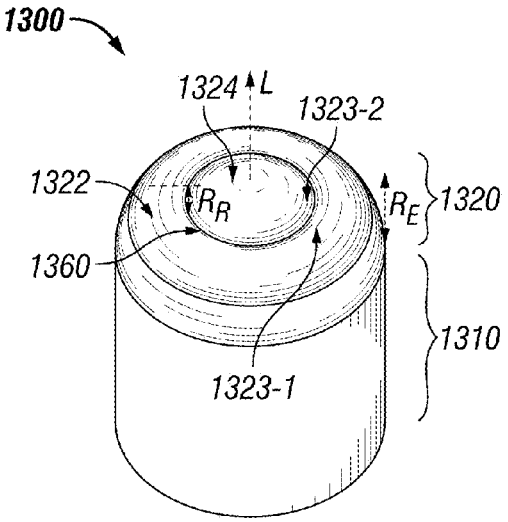
FIG. 13 is a perspective view of another illustrative cutting element, according to one or more embodiments of the present disclosure.
Figures 1, 14:
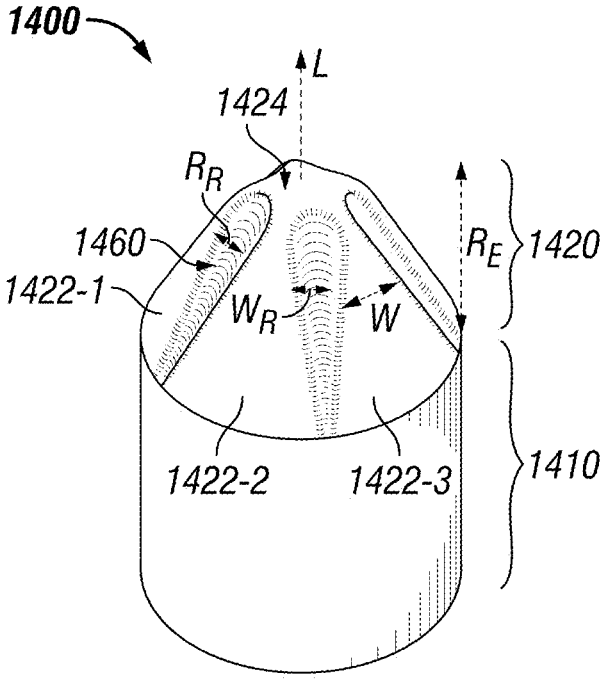
Figures 2, 14:
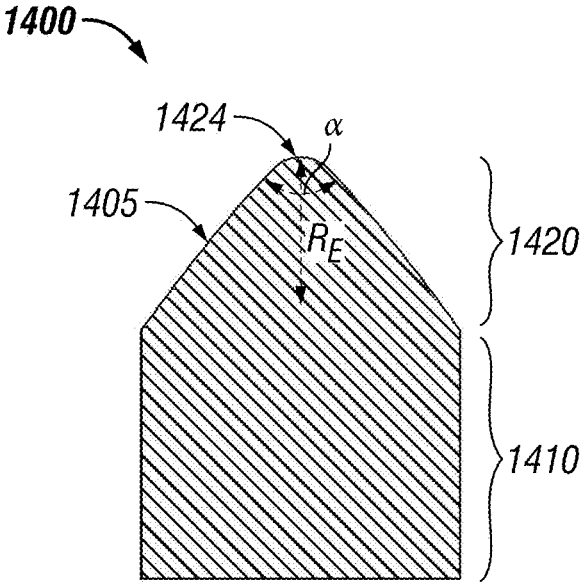

As used herein, a sharp profile may be used to refer to a crest portion or other portion of a cutting insert having a radius of curvature less than the radius of the base portion 910, and a blunt profile may refer to a portion having a radius of curvature greater than or equal to the value of the radius of the base portion 910. In other embodiments, as shown in FIG. 3, the cutting insert 100 may have a cutting profile that includes a blunt profile. In other embodiments, such as shown in FIG. 14-2 (described below) a cutting insert 1400 may have a cutting profile that includes a sharp profile. In yet other embodiments, such as shown in FIGS. 12-2 and 13 (described below), a cutting insert may have a cutting profile that includes a combination of blunt profiles and/or sharp profiles. Further, in some embodiments, the sharp profile may include a radius of curvature that is less than about 80%, about 70%, about 60%, about 50%, about 40%, or about 30% of the radius of the base portion. Moreover, in some embodiments, the blunt profile may have a radius of curvature that is greater than about 110%, about 120%, about 130%, or about 140% of the radius of the base portion.

FIGS. 12-1 and 12-2 depict perspective and cross-sectional views, respectively, of another illustrative cutting element 1200, according to one or more embodiments. The cutting element 1200 may have a base portion 1210, an extension portion 1220 extending a distance $R_E$ from the base portion 1210 along or parallel to a longitudinal axis L of the cutting element 1200, and at least one relief 1260 formed in the outer surface of the extension portion 1220. As shown, the relief 1260 may be formed from two surfaces 1223-1, 1223-2 intersecting at an angle δ. The relief may be formed between the crest portion 1224 and a remaining portion 1222 of the extension portion 1220, may have a substantially circular shape, and may extend circumferentially around the crest portion 1224. Thus, in contrast to some other embodiments illustrated herein in which the relief extended significantly in a radially outward direction, the relief 1260 illustrated in FIGS. 12-1 and 12-2 may extend primarily circumferentially, and may exist as an annular relief between the crest portion 1224, and the lobe (i.e., the remaining portion 1222) that extends around the circumference of the cutting element 1200. The relief 1260 may have a height $R_R$ measured from the lowest part of the relief 1260 (e.g., at the intersection of the two surfaces 1223-1, 1223-2) to the top part of the remaining portion 1222 of the extension portion 1220. Further, as shown in FIGS. 12-1 and 12-2, the extension portion 1220 may have an outer radius larger than the radius of the base portion 1210. In some embodiments, the cutting element 1200 may have a mushroom-like shape.

As shown in FIG. 12-2, the cutting profile 1205 of the cutting element 1200 may have a combination of blunt profiles, including a substantially spherical shape with a semi-round center (formed by the crest portion 1224) encircled by the relief 1260. Such a cutting profile 1205 may cause communication between two cracks propagating from adjacent craters formed by insert blows. In other embodiments, the cutting profile may be formed from multiple sharp profiles, or a combination of sharp and blunt profiles.

FIG. 13 depicts a perspective view of another illustrative cutting element 1300, according to one or more embodiments. The cutting element 1300 may have a base portion 1310, an extension portion 1320 extending a distance $R_E$ from the base portion 1310 along a longitudinal axis L of the cutting element 1300, and at least one relief 1360 formed in the outer surface of the extension portion 1320. The relief 1360 may be formed from two surfaces 1323-1, 1323-2 intersecting at an angle, and may extend around a crest portion 1324, between the crest portion 1324 and the remaining portion of the extension portion 1320. As shown, the remaining portion of the extension portion 1320 may be a lobe 1322, and in some embodiments the relief 1360 and/or the lobe 1322 may have a substantially circular shape.

Rather than extending a radial distance from the crest portion 1324 to the base portion 1310 as described in embodiments herein (see, e.g., FIG. 9), the lobe 1322 may extend circumferentially around the crest portion 1324 with the relief 1360 formed between the lobe 1322 and the crest portion 1324. The relief 1360 may have a height $R_R$ measured from the lowest part of the relief 1360 (e.g., at the intersection between the two surfaces 1323-1, 1323-2) to the uppermost portion of the lobe 1322. Further, the cutting element 1300 shown in FIG. 13 may have a combination of blunt and sharp profiles, including a blunt edge cutting profile and a sharp, conical, or frustoconical center profile. Particularly, the crest portion 1324 may have a sharp or substantially conical or frustoconical cutting profile in which the edges are truncated to form a cutting element 1300 with elements of a conical insert and a blunt wedge. Such a cutting profile may contact and cut a formation using a first fracture mode of crushing and a second fracture mode of chipping.

According to embodiments of the present disclosure, cutting elements may have reliefs of various shapes, configurations, or orientations formed in the extension portion or cutting portion of the cutting element. Some reliefs may include groove-type reliefs are reliefs that are shaped similar to grooves (and thus may be referred to as "grooves"), which may include a U-shaped, V-shaped, or other channel extending along a path and defining a linear, tapered, or tear drop geometry. However, it should be noted that reliefs according to other embodiments of the present disclosure may have other shapes and geometries and, thus, the term "relief" may be used to refer broadly to relief shapes and geometries, including groove shapes. According to some embodiments, reliefs may have various geometries, and each relief may have at least two surfaces that intersect (e.g., a side surface with a base surface or another side surface). In some embodiments, the at least two surfaces may intersect at an angle; however, in other embodiments, the two surfaces may form a continuous curve.

FIGS. 14-1 and 14-2 depict perspective and cross-sectional views, respectively, of another illustrative cutting element 1400, according to one or more embodiments. The cutting element 1400 may have a base portion 1410, an extension portion 1420 extending a distance $R_E$ from the base portion 1410, and a plurality of grooves 1460 formed in the extension portion 1420. In some embodiments, the base portion 1410 may extend along or parallel to the longitudinal axis L. The grooves 1460 may extend radially from a crest portion 1424, or cutting tip, to the outer radius/perimeter of the cutting element 1400 and longitudinally toward the base portion 1410. The grooves 1460 may have a relief height $R_R$ measured from the bottom of the groove 1460 to the top or outer surface of the surrounding extension portion 1420. The relief height $R_R$ may remain generally constant, or may vary along the length of the groove 1460. Further, as shown, the grooves 1460 may have a width $W_R$ that gradually decreases along the radial distance of each groove 1460, resulting in a plurality of lobes 1422-1, 1422-2, and 1422-3 formed on either side of each relief that increase in width W in a direction extending towards the base portion 1410 and the outer radius or perimeter of the cutting element 1400. In other embodiments, a groove may decrease in width in a radially outward direction, have a generally constant width, or have varying sections of increasing or decreasing width.

Further, as shown in FIG. 14-2, the cutting profile 1405 of the cutting element 1400 may include a sharp profile. The conical shaped cutting profile may provide a high rate of penetration due to the sharp geometry, but may also face high torque issues. By forming groove-shaped reliefs 1460 in the cutting portion of the cutting element 1400, the grooves 1460 may relieve the high torque issues and also provide for efficient removal of crushed material after chip formation. Sharp, conical, and frustoconical profiles may include a crest portion 1424 having a curvature thereon. In some embodiments, the radius of the curvature may be between about 0.5 mm and about 5 mm. For example, in some embodiments, the radius of curvature may range from about 1.3 mm to about 3.2 mm. In some embodiments, the curvature may include a variable radius of curvature, a portion of a parabola, a portion of a hyperbola, a portion of a catenary, a portion of a circle, a portion of an ellipse, a parametric spline, or some combination of the foregoing. Further, as shown in FIG. 14-2, sharp, conical, or frustoconical profiles may include a cone angle $\alpha$, which may be selected based on the particular formation to be drilled. In a particular embodiment, the cone angle $\alpha$ may range from a low of about 30°, about 45°, about 60°, or about 75° to a high of about 90°, about 105°, about 120°, about 135°, or more.

Figures 1, 15:
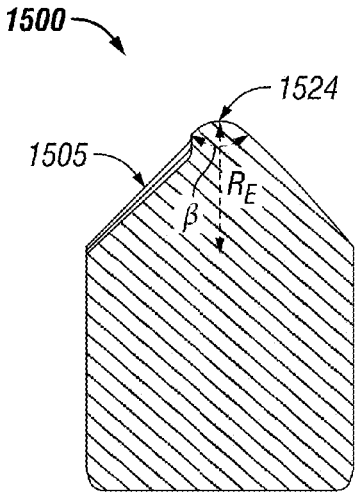
Figures 2, 15:
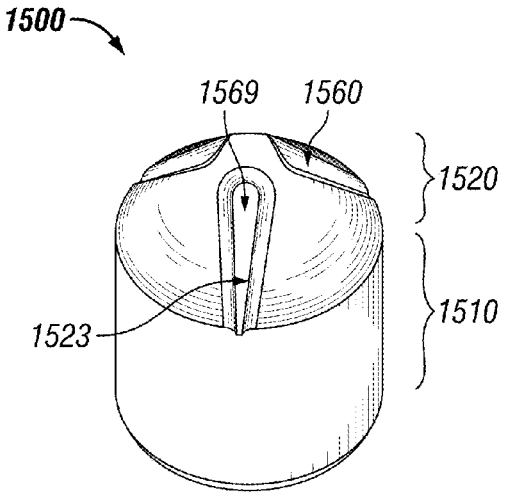

FIGS. 15-1 and 15-2 depict cross-sectional and perspective views, respectively, of an illustrative cutting element 1500, according to one or more embodiments. The cutting element 1500 may have a base portion 1510, an extension portion 1520, and a plurality of reliefs 1560. The extension portion 1520 may extend longitudinally a distance $R_E$ from the base portion 1510, while the reliefs 1560 may extend a radial distance from a crest portion 1524 toward (and optionally fully to) an outer radius/perimeter of the cutting element 1500 or extension portion 1520. Each relief 1560 may have one or more surfaces. In the illustrated embodiment, for instance, the reliefs 1560 may each include a bottom surface 1569 intersecting at least two side surfaces 1523. The side surfaces 1523 may each intersect the bottom surface 1529 at an angle. Such angles may be the same, or may be different. As shown, three reliefs 1560 may be formed in the extension portion 1520. However, other embodiments may include more or fewer than three reliefs 1560 formed in the extension portion 1520 of the cutting element 1500, and optionally extending radially from the crest portion 1524 toward the outer radius of the cutting element 1500. Further, other geometries of reliefs 1560 may be formed in the extension portion 1520 of the cutting element 1500, extending radially from the crest portion 1524 to the outer radius of the cutting element 1500.

Figures 1, 16:
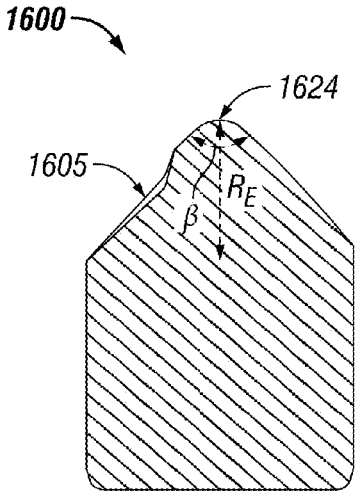
Figures 2, 16:
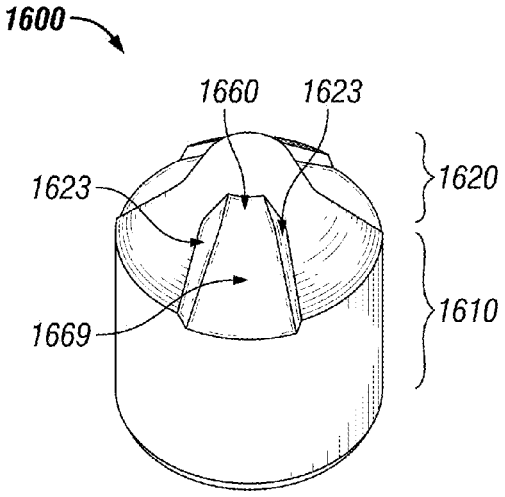

FIGS. 16-1 and 16-2 depict cross-sectional and perspective views, respectively, of another illustrative cutting element 1600, according to one or more embodiments. The cutting element 1600 may have a base portion 1610, an extension portion 1620 extending longitudinally a distance $R_E$ from the base portion 1610, and a plurality of reliefs 1660. The reliefs 1660 may extend a radial distance from a crest portion 1624 toward an outer radius of the cutting element 1600.

Each relief 1660 may have a bottom surface 1669 and at least two side surfaces 1623 intersecting the bottom surface 1669. In the illustrated embodiment, each side surface 1623 may intersect the bottom surface 1669 at an angle. Each relief 1660 may have a substantially constant width; however, the illustrated embodiment depicts reliefs 1660 which may vary along their lengths while extending in a radially outward direction. The width may be measured across the bottom surface 1669 between two opposite side surfaces 1623. For example, as shown, the reliefs 1660 may have a kernel shape, and the width of each relief may generally increase in a radially outward direction. However, according to other embodiments, the width of the reliefs 1560 may decrease in a radially outward direction, be substantially constant in a radially outward direction, or have a combination of increasing, decreasing, or constant width moving radially outward.

Further, the cutting elements shown in FIGS. 15-1 and 16-1 may have conical cutting profiles 1505, 1605 with extended crest portions 1524, 1624. More particularly, the crest portions 1524, 1624 may have convex outer surfaces relative to the respective base portion 1510, 1610, such that the outer surface may form an angle $\beta$. Where the outer surface of the crest portions 1524, 1624 are symmetric, the angle between the outer surface and the longitudinal axis may be $\beta/2$, and may be less than about 45°. Such cutting profiles 1505, 1605 may provide a sharp nose or tip (formed by the convex-shaped crest), while the three or more grooves may provide a shear plane for sliding of powdered rock. Additionally, the crest portion 1524, 1624 may facilitate the volume of formation removal after plastic fracture.

While FIGS. 15-2 and 16-2 illustrate grooves 1560, 1660 which may extend in a generally linear, radially outward direction, the grooves 1560, 1660 or other reliefs may have other structures, geometries, and the like. For instance, grooves or other reliefs may extend radially outward along a curved, angled, helical, or other path. Moreover, while the grooves 1560, 1660 may extend fully to the outer perimeter of a respective cutting element 1500, 1600, other embodiments contemplate a groove 1560, 1660 which does not extend fully to the outer perimeter. In still other embodiments, a lobe may not extend fully to the outer perimeter of the cutting element 1500, 1600, such as where a circumferential relief is formed at the outer perimeter of the cutting element 1500, 1600.

Cutting elements of the present disclosure may be formed of, for example, tungsten carbide, tungsten carbide with a super-abrasive material surface, such as polycrystalline diamond ("PCD") or cubic boron nitride ("PCBN"), and carbides, nitrides, borides, other matrix materials, or some combination of the foregoing.

During percussion or hammer drilling operations, a percussion drill bit mounted to the lower end of a drill string may impact the formation in a cyclic fashion to crush, break and loosen the subterranean formation material. The percussion cutting mechanism for penetrating the formation is of an impacting nature. A percussion drill bit may also rotate or index between impacts of the percussion drill bit. In some embodiments, a slight rotational movement between each impact blow may be used in order to avoid the cutting elements impacting the same portion of the formation as during an immediately prior impact.

Figure 17:
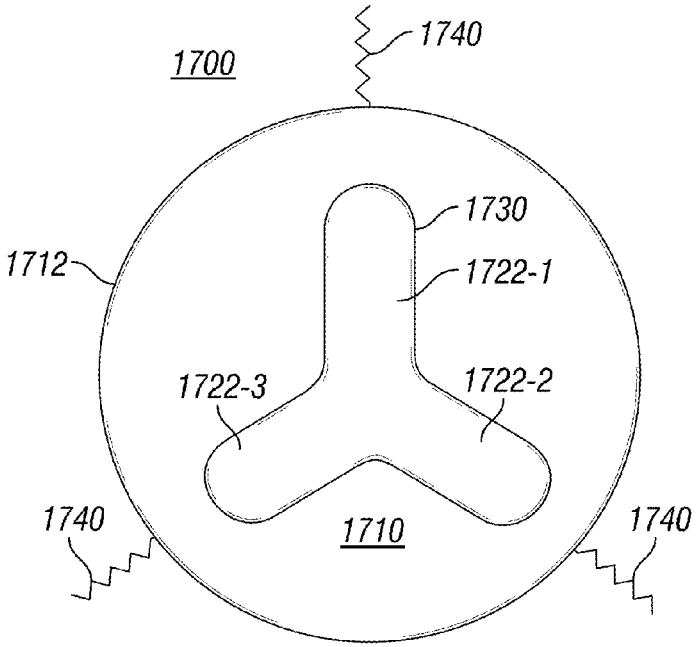
FIG. 17 depicts an illustrative impact crater in a subterranean formation as may be formed by a cutting element having three lobes, according to one or more embodiments of the present disclosure.

FIG. 17 depicts an illustrative impact crater 1710 in a subterranean formation 1700 as may be formed by a cutting element having three lobes (e.g., cutting element 500 in FIG. 7 or cutting element 600 in FIG. 8-1) according to one or more embodiments. The impact crater 1710 may have a border 1712 (i.e., the outer radial edge) and the impression of three lobes 1722-1, 1722-2, 1722-3. The lobe impressions 1722-1, 1722-2, 1722-3 shown may not extend to the border 1712 of the crater 1710; however, in some embodiments, the lobe impressions 1722-1, 1722-2, 1722-3 may extend to the border 1712.

Each lobe impression 1722-1, 1722-2, 1722-3 may have an outer radial portion 1730. One or more cracks 1740 may be formed in the formation 1700 by the impact. The cracks 1740 may initiate or originate proximate the outer radial portion 1730 of the lobe impressions 1722-1, 1722-2, 1722-3 and/or at the border 1712 of the impact crater 1710.

Figure 18:
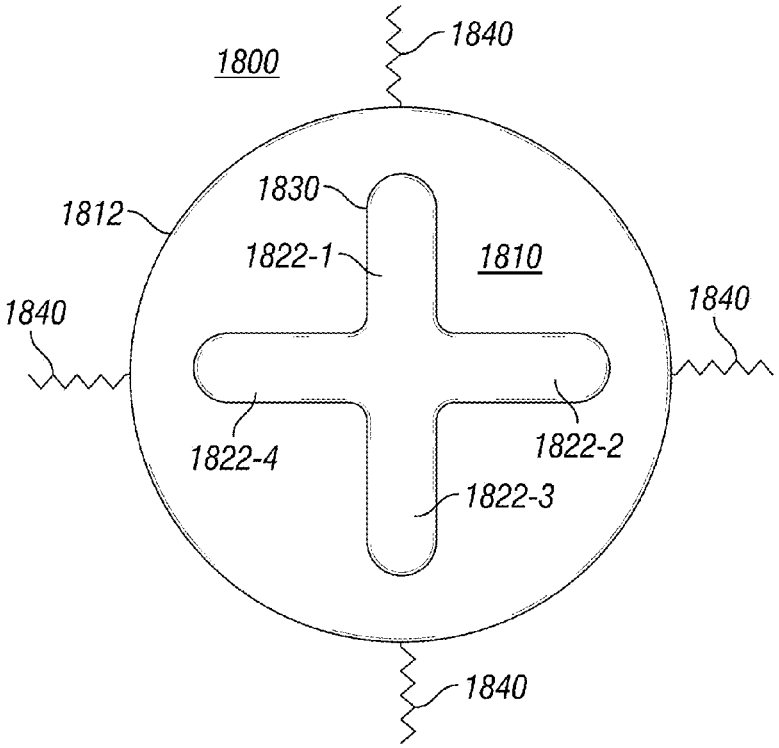
FIG. 18 depicts an illustrative impact crater in a subterranean formation as may be formed by a cutting element having four lobes, according to one or more embodiments of the present disclosure.

FIG. 18 depicts an illustrative impact crater 1810 in a subterranean formation 1800 formed by a cutting element having four lobes (e.g., cutting element 700 in FIG. 9 or cutting element 800 in FIG. 10), according to one or more embodiments. The impact crater 1810 in FIG. 18 may have a border 1812 (i.e., the outer radial edge) and the impression of four lobes 1822-1, 1882-2, 1822-3, 1822-4. The lobe impressions 1822-1, 1882-2, 1822-3, 1822-4 shown may not extend to the border 1812 of the crater 1810; however, in some embodiments, the lobe impressions 1822-1, 1882-2, 1822-3, 1822-4 may extend fully to the border 1812. In some embodiments, the border 1812 may not be formed, and an outer radial portion 1830 of each lobe impression 1822-1, 1882-2, 1822-3, 1822-4 may form the radially outermost portion of the impact crater 1810. Regardless of whether a border 1812 is formed, one or more cracks 1840 may form in the formation 1800 upon impact. Such cracks 1840 may initiate or originate proximate the border 1812 and/or the outer radial portions 1830 of the lobe impressions 1822-1, 1882-2, 1822-3, 1822-4.

According to embodiments of the present disclosure, cutting elements, such as the ones described herein, may be strategically positioned on the face of the drill bit to induce cracks with a greater chance of joining or linking. For example, according to some embodiments, the cutting elements may be positioned/oriented on the face of the drill bit such that the areas having an increased likelihood of crack initiation (e.g., proximate the outer radial portion of a lobe impression and/or the border of the impact crater), thereby increasing the likelihood of cracks forming and joining during a single bit impact event. According to other embodiments, the cutting elements may be positioned/oriented around the face of the drill bit having a translational or rotational offset between adjacent cutting elements, such that crack initiation from the cutting elements in an impact event overlaps or is in close proximity with the crack initiation from a subsequent impact event. By translationally or rotationally offsetting the cutting elements along the face of the drill bit to provide cracks overlapping or adjacent to cracks from a previous impact event, increased crack joining may be achieved.

During percussion or hammer drilling operations, a percussion drill bit mounted to the lower end of a drill string may impact the formation in a cyclic fashion to crush, break, and loosen formation material. The percussion drilling mechanism for penetrating the formation is of an impacting nature. A percussion drill bit may also have small or other angular displacements per impact of the percussion drill bit (i.e., the percussion drill bit may index and have a slight rotational movement for each impact blow), in order to avoid the cutting elements from impacting the same portion of the formation, or in the same orientation in the same position, as during the previous impact.

Figures 1, 19:
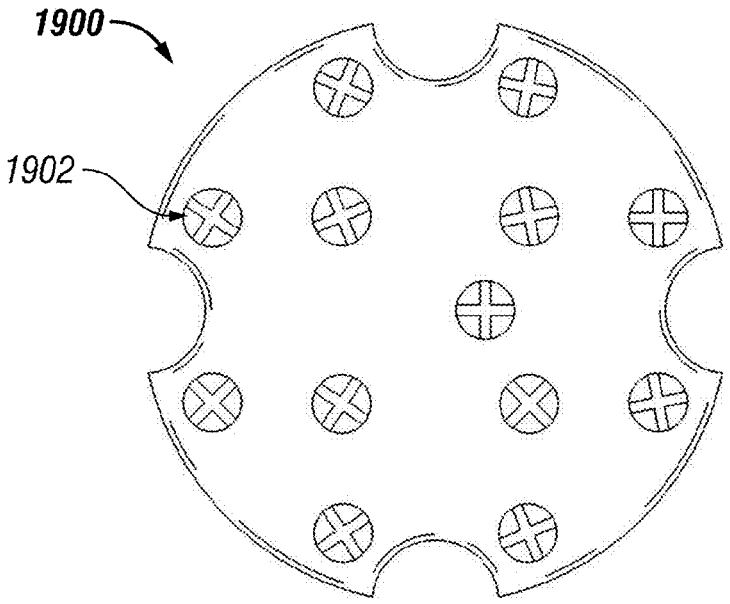
Figures 2, 19:
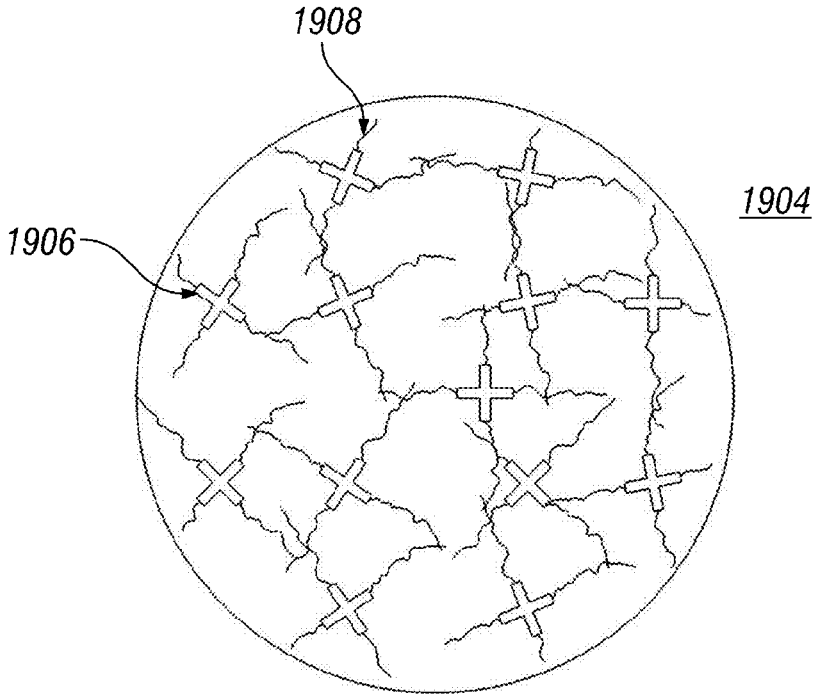

FIG. 19-1 depicts an illustrative bit face 1900 of a percussion drill bit having a plurality of illustrative cutting elements 1902, and FIG. 19-2 depicts a subterranean formation 1904 having a plurality of illustrative cracks 1908 formed after being contacted with the bit face 1900, according to one or more embodiments. The cutting elements 1902 (e.g., cutting elements 700 in FIG. 9 or cutting elements 800 in FIG. 10) may be positioned on the bit face 1900 of the bit such that the areas having an increased likelihood of crack initiation (e.g., the outer radial portions of the lobes) are aligned or proximate with each other, thereby increasing the likelihood of cracks 1908 forming and joining during a single bit impact event. As shown, the impact made by one bit blow on the subterranean formation 1904 may include plastic failure at some or each impact crater 1906, and each impact crater 1906 may have a shape corresponding to the contact surface of the cutting elements 1902. The impact may also have a high degree of brittle failure due to crack 1908 interlinking.

Figures 1, 20:
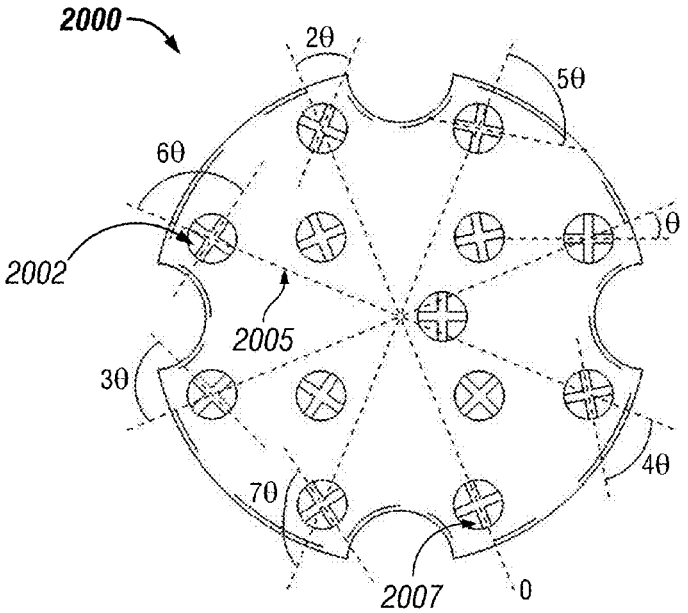
Figures 2, 20:
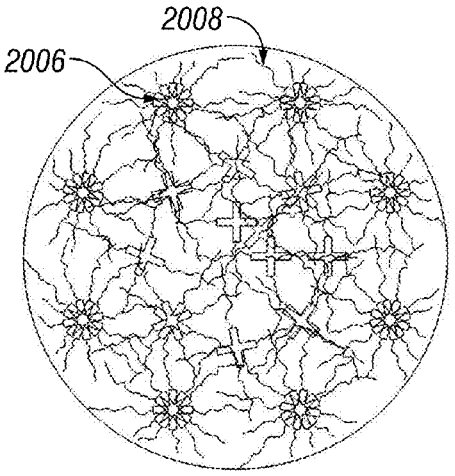
Figures 3, 20:
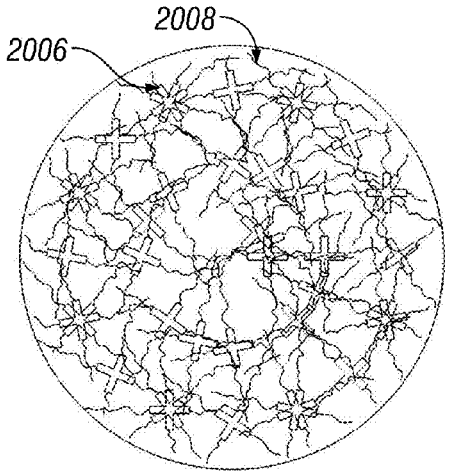

FIG. 20-1 depicts a bit face 2000 of a percussion drill bit having illustrative cutting elements 2002, and FIGS. 20-2 and 20-3 depict a subterranean formation 2004 after being contacted with the bit face 2000 three times, according to multiple embodiments of the present disclosure. The cutting elements 2002 may be spaced circumferentially around the bit face 2000. In some embodiments, the bit face 2000 may rotate between successive impacts, and the rotation of the bit face 2000 may be about the same as the circumferential spacing between two or more cutting elements 2002, such that crack initiation from the cutting elements 2002 in an impact event overlaps with or is in close proximity with the crack initiation from a subsequent impact event. FIG. 20-2 illustrates an example where impact sites 2006 corresponding to radially outermost cutting elements 2002 overlap with each of three successive impacts. The impact made by the cutting elements 2002 includes plastic failure shown by the impact craters 2006 of the cutting elements 2002 and a high degree of brittle failure due to crack 2008 interlinking.

In the embodiment shown, the cutting elements 2002 may be positioned in a circumferential row around the gage or periphery of the bit face 2000. Optionally, at least some of the cutting elements 2002 may have differing rotational offsets. FIG. 20-1, for instance, illustrates each of eight cutting elements 2002 having a different rotational offsets. As used herein, a rotational offset refers to a difference in alignment with respect to a selected direction between at least two cutting elements. For example, a rotational offset shown in FIG. 20-1 may be measured with respect to alignment with a radial axis from the bit's rotational axis to the cutting element longitudinal axis. As shown, each cutting element 2002 in a circumferential row may have an outer radial portion of a lobe positioned at an angle from a line 2005 intersecting the rotational axis of the bit face 2000 and the longitudinal axis of the cutting element 2002. The angle of each cutting element 2002 may vary (and may optionally incrementally increase going around a circumferential row). For example, a first cutting element 2007 may be aligned with its radial axis 2005 (i.e., have a 0° offset from its radial axis), a second cutting element around the circumferential row may be rotationally offset from the first cutting element 2007 by $\theta$, a third cutting element around the circumferential row may be rotationally offset by $2\theta$, and other cutting elements around the circumferential row may be rotationally offset by $3\theta$, $4\theta$, $5\theta$, $6\theta$, $7\theta$, or more. According to embodiments of the present disclosure, cutting elements 2002 may be rotationally offset from their radial axes by an angle ranging from a low of about 0°, about 30°, about 60°, or about 90° to a high of about 135°, about 180°, about 225°, about 270°, or more. Further, some embodiments may include cutting elements 2002 having a decreasing rotational offset and may include one or more circumferential rows, or may include cutting elements 2002 having a rotational offset along a non-circumferential direction. In the illustrated embodiment, the rotational offset is shown as increasing in a counterclockwise direction around the outer circumferential row, with about every other cutting element 2002 from 0 to 3θ and from 4θ to 7θ having an increased offset. In other embodiments, the rotational offset may increase incrementally between adjacent cutting elements, or in other manners.

FIG. 20-2 illustrates an example embodiment in which the rotation of the bit face 2000 (i.e., indexing) is about equal to the circumferential spacing between two cutting elements 2002 on the outer circumferential row. As a result, with each successive impact, impact craters may be formed which overlap or nearly overlap. With differing rotational offsets, the lobes of each cutting element 2002 may form impact craters oriented in different directions, which may increase plastic failure and lead to a high degree of brittle failure due to crack 2008 interlinking.

FIG. 20-3 illustrates another example embodiment in which one or more impacts may not be indexed to the circumferential offset between outermost cutting elements 2002. In this embodiment, a second of three impacts may create intermediate impact craters 2006. Such impact craters may reduce the distance between impact craters, thereby facilitating crack 2008 interlinking. Rotational offsets of the cutting elements 2002 may lead to orientations along lobes that align cracks in a direction likely to increase crack interlinking.

Figure 21:
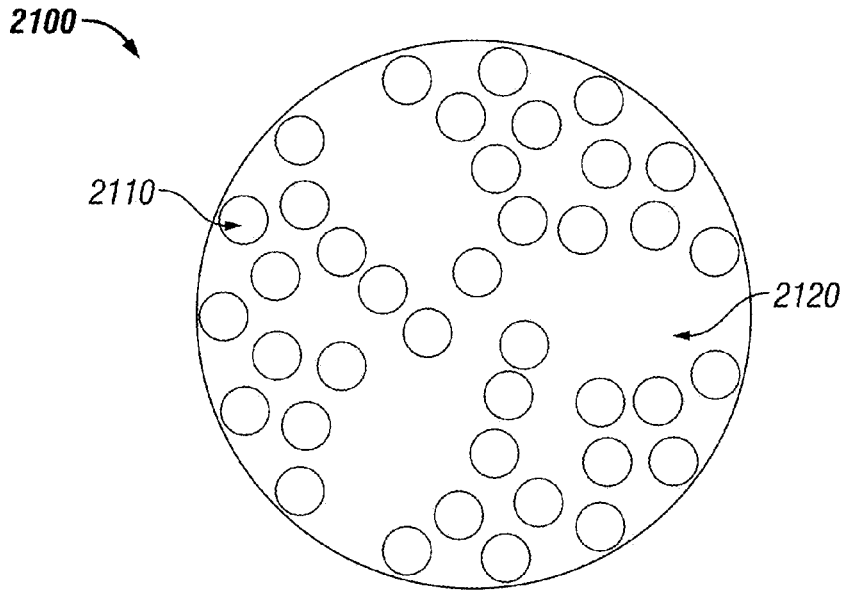
FIGS. 21 and 22 schematically depict a bit face of a percussion drill bit having a plurality of cutting elements coupled thereto, according to one or more embodiments of the present disclosure.
Figure 22:
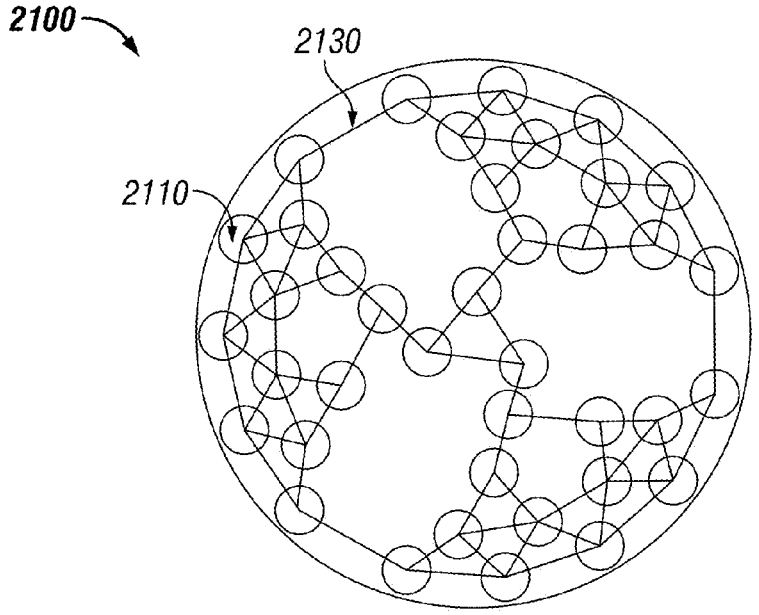

FIGS. 21 and 22 schematically depict a bit face 2100 of a percussion hammer bit including a plurality of cutting elements 2110, according to one or more embodiments. As shown, the placement of the cutting elements 2110 may be driven by the size and position of one or more fluid channels 2120 formed between the cutting elements 2110. Spacing, strength constraints, and other factors which may cause smaller gaps between proximate cutting elements may also influence cutting element 2110 placement.

As shown in FIG. 22, proximity lines 2130 may be determined between adjacent cutting elements 2110. The proximity lines 2130 may represent the most likely areas in which cracks will form in the rock formation during a single impact event through brittle fracture. Crack inducement along the proximity lines may be improved, leading to enhanced brittle failure interlinking, by positioning cutting elements having at least one crack initiation site on the bit face 2100, such that the crack initiation sites are directed along the proximity lines. As described above, a crack initiation site may be located at a radius of curvature along a contact surface of the cutting element. In some embodiments, crack initiation sites may correspond to locations of lobes of a cutting element 2110.

According to embodiments of the present disclosure, the bit face 2100 may have areas of relatively higher cutting element density and areas of relatively lower cutting element density. For example, as shown in FIGS. 21 and 22, the bit face 2100 may have low cutting element density at areas of the bit face 2100 occupied by fluid channels 2120 and relatively high cutting element density elsewhere on the bit face 2100. However, cutting element density may be relative to selected areas of the bit face 2100 and, thus, areas of low cutting element density may also be selected as particular regions between the channels 2120.

Figure 23:
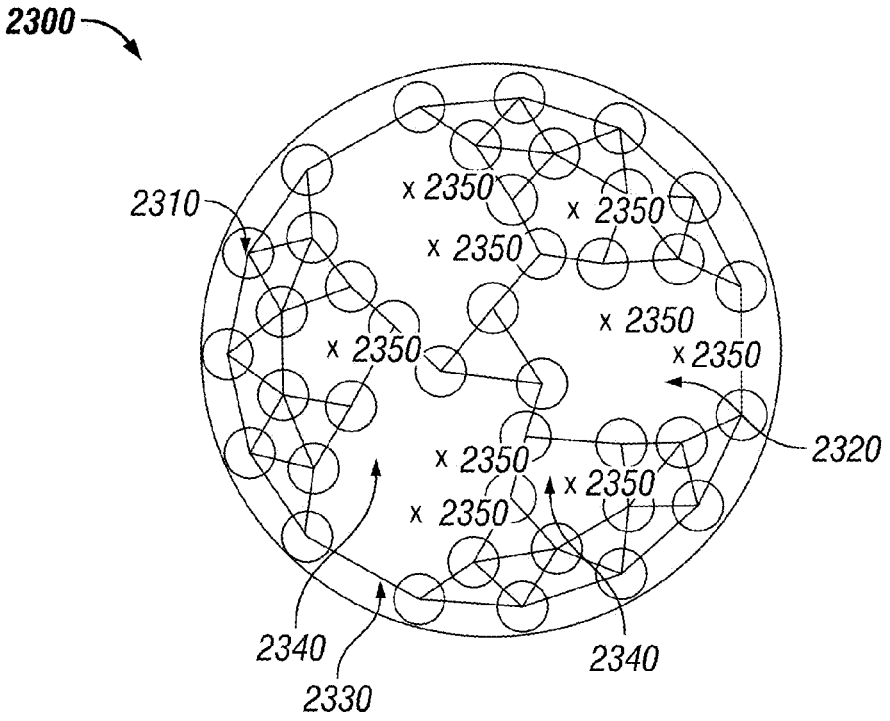
FIG. 23 schematically depicts a bit face of a percussion drill bit having a plurality of cutting elements coupled thereto, with proximity lines illustrated between the most proximate cutting elements, according to one or more embodiments of the present disclosure.

FIG. 23 schematically depicts a bit face 2300 including a plurality of cutting elements 2310 disposed thereon and proximity lines 2330 between the most proximate cutting elements 2310, according to one or more embodiments. At least one low cutting element density region 2340 may be selected including an area of the bit face 2300 having a lower density of cutting elements 2310 compared with another area of the bit face 2300. For example, as shown in FIG. 23, an area of low cutting element density 2340 may be selected as the region of the channels 2320 or as a region between the channels. However, other regions of low cutting element density may be selected relative to a higher cutting element density region on the bit face 2300. Upon selecting regions having low cutting element density, at least one point 2350 may be generated in the low cutting element density region 2340. The points 2350 may be close or correspond to the nearest point between neighboring cutting elements 2310. Further, more than one point may be generated in a low cutting element density region 2340. For example, multiple points 2350 may be generated in large areas of low cutting element density, such as in the channel 2320 region, while one point 2350 may be generated in smaller areas of low cutting element density, such as between cutting elements 2310 in the regions between the channels 2320.

Figure 24:
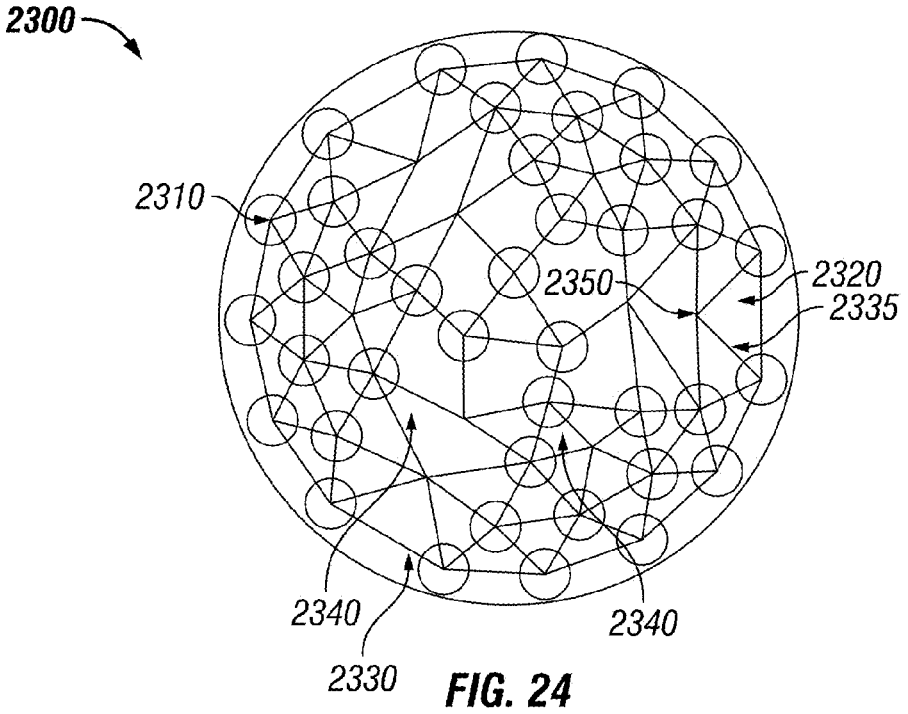
FIG. 24 schematically depicts proximity lines between a generated point and the most proximate cutting elements, according to one or more embodiments of the present disclosure.

FIG. 24 depicts proximity lines 2335 disposed between a generated point 2350 and its most proximate cutting elements 2310, according to one or more embodiments. Further inducement of cracks may be directed along these proximity lines 2335 to the generated points 2350, which may be areas of lesser crack formation due to the lower cutting element density around the generated points. Particularly, the cutting elements 2310 may be positioned such that the outer radial portions of the lobes are positioned along the proximity lines 2335 toward a generated point 2350.

Figure 25:
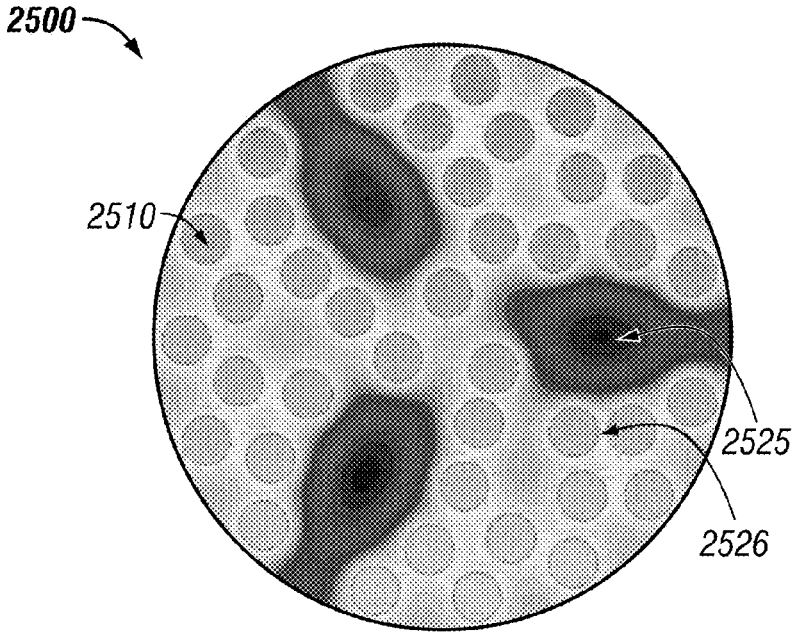
FIG. 25 schematically depicts an illustrative impact pattern for a percussion drill bit having a plurality of cutting elements coupled to a bit face of the percussion drill bit, according to one or more embodiments of the present disclosure.

FIG. 25 depicts an illustrative impact pattern 2500 for a percussion bit having a plurality of semi-round top cutting elements dispersed around the bit face, according to one or more embodiments. Particularly, impact craters 2510 may be modeled in positions corresponding with the respective cutting element locations of on the bit face. The modeling may be done by finite element analysis. The impact craters 2510 may be modeled with a uniform input, simulating a uniform probability of crack initiation around each cutting element to determine probability densities of crack initiation. As shown, the areas having relatively lower cutting element density 2525 (compared with other areas of cutting element density) may have lower or improbable crack propagation, while the areas having relatively higher cutting element density 2526 may have higher or more likely crack propagation.

By modeling areas of probability density of crack initiation, areas of low probability density of crack initiation (compared with other areas of probability density of crack initiation) may be selected and targeted for designing improved crack initiation impact patterns. For example, semi-round top cutting elements may be replaced with cutting elements having at least one crack initiation site. Cutting elements may also be oriented to place crack initiation sites toward one or more areas of low probability density of crack initiation.

Figure 26:
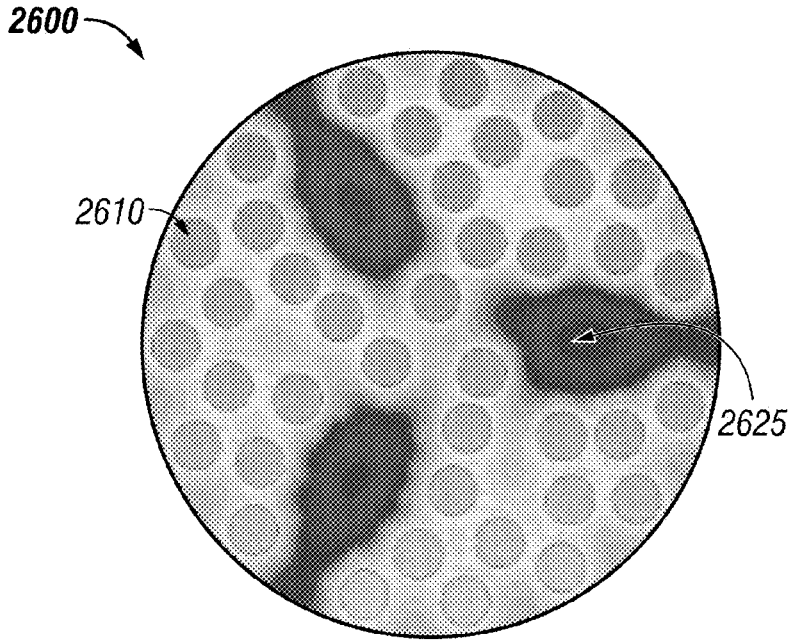
FIG. 26 depicts another illustrative pattern for a percussion drill bit having a plurality of cutting elements coupled to a bit face of the percussion drill bit, according to one or more embodiments of the present disclosure.

FIG. 26 depicts an illustrative impact pattern 2600 for a percussion bit having a plurality of cutting elements with crack initiation sites (e.g., lobes), according to one or more embodiments. The impact pattern 2600 may be modeled with a combination of a uniform input and an increased input, corresponding to appropriately placed and oriented cutting elements with crack initiation sites, such as increased input at the crack initiation sites. Further inducement of cracks directed toward weak areas of cracks (e.g., areas of low probability density of crack initiation) may be quantified by comparing the impact pattern 2600 shown in FIG. 26 (showing the impact from cutting elements having crack initiation sites directed toward low probability densities of crack initiation) with the impact pattern 2500 shown in FIG. 25 (showing the impact from cutting elements without crack initiation sites). For example, as shown in FIG. 26, the impact pattern 2600 shows the impact craters 2610 of cutting elements having crack initiation sites directed toward low probability densities of crack initiation, such that the areas of low probability density of crack initiation 2625 may have a higher or more likely crack propagation when compared to the same areas of low probability density of crack initiation 2525 shown in FIG. 25.

Figure 27:
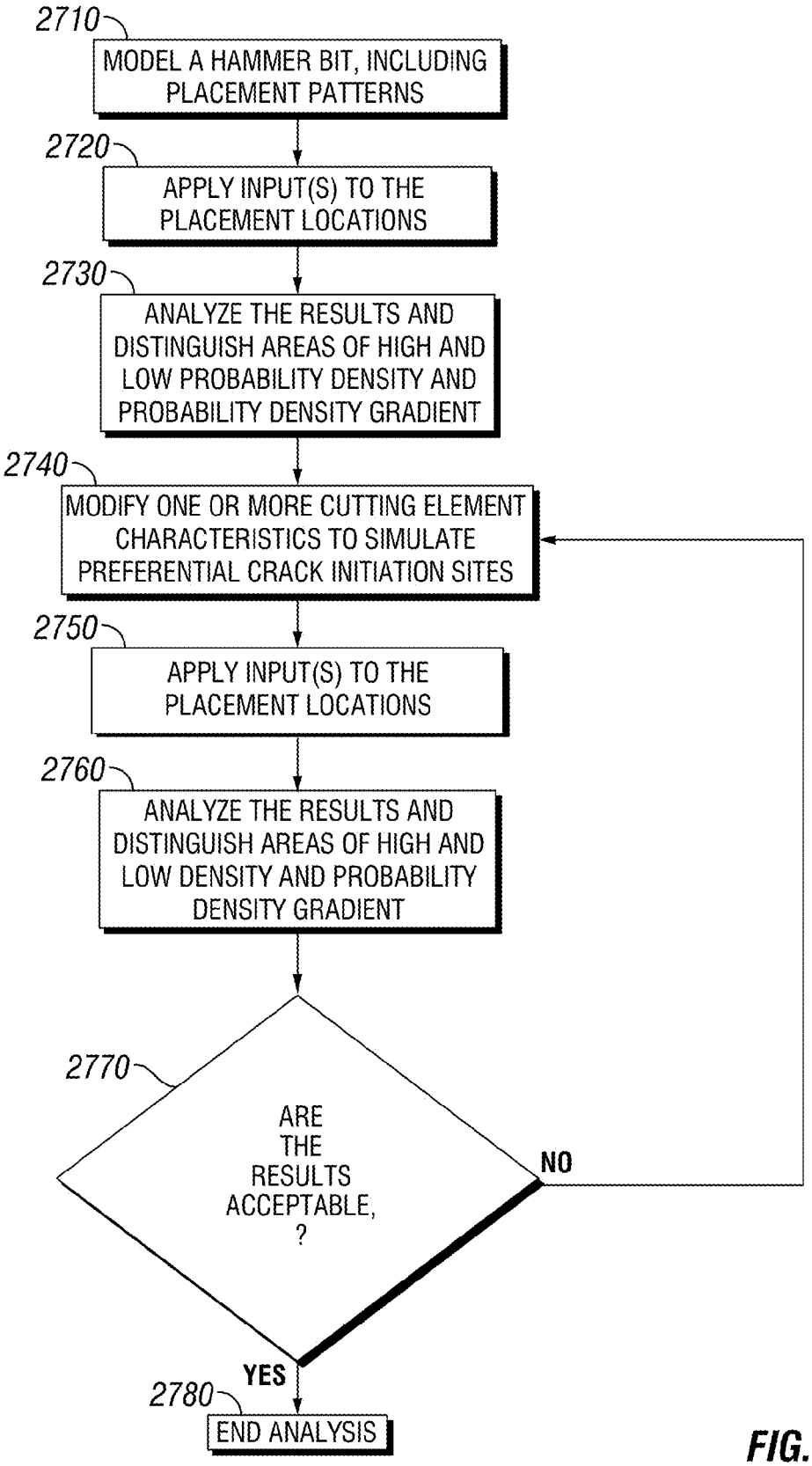
FIG. 27 is a flowchart of an illustrative method for designing a percussion hammer bit, according to one or more embodiments of the present disclosure.

Additionally, placement and orientation of cutting elements with crack initiation sites may be optimized by iteratively modeling and analyzing the crack probability density. FIG. 27 depicts a flowchart of an illustrative method for designing a bit, according to one or more embodiments. A placement pattern of the cutting elements on a hammer bit may be modeled, as shown at 2710. One or more inputs may be applied to the placement locations, as shown at 2720. For instance, a uniform input may be applied to the cutting element placement locations. A uniform input may include, for instance, modeling each cutting elements as a semi-round top cutting element. The results may be analyzed, and areas of high and low probability density and the probability density gradient may be distinguished, as shown at 2730.

One or more of the cutting element characteristics may be modified to simulate preferential crack initiation sites, as shown at 2740. For instance, the location, position, or orientation of a cutting element or lobe of a cutting element may be modified. Inputs may then be applied to the placement locations, as shown at 2750. For instance, a uniform input and/or additional preferential inputs may be applied to the cutting element placement locations. Preferential inputs may include, for instance, directional information about the orientation of lobes of a cutting element, the number of lobes, the type of structure of lobes or an extension portion of a cutting element, and the like. The results may be analyzed, and areas of high and low probability density and the probability density gradient may be distinguished, as shown at 2760. It may then be determined whether the results are acceptable at 2770. This determination may be based upon any number of considerations. For instance, the determination may include a comparison of probability density plots, the minimization or maximization of probability density, the probability density gradient, other factors, or some combination of the foregoing. If the results are acceptable, the analysis may be concluded, as shown at 2780. If the results are not acceptable, the cutting element placement, the number of cutting elements, the orientation of crack initiation inputs, the type of cutting elements, or the like may be optimized by again modifying one or more cutting element characteristics, as shown at 2740. Such inputs may then again be applied at 2750, and the results analyzed at 2760 (e.g., by comparing probability density plots, minimizing/maximizing probability density, or considering a probability density gradient). Various acts within the method of FIG. 27 may repeat many times until an affirmative result is obtained at 2770.

Figure 28:
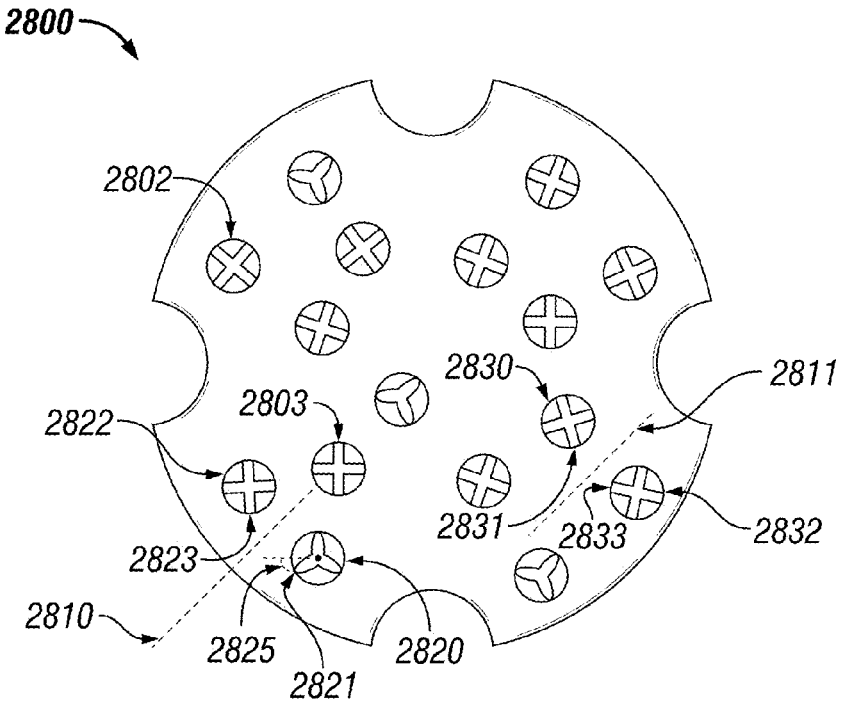
FIG. 28 depicts a bit face having a plurality of cutting elements coupled thereto, according to one or more embodiments of the present disclosure.

FIG. 28 depicts a bit face 2800 having a plurality of cutting elements 2802 disposed thereon, according to one or more embodiments. As shown, the cutting elements 2802 may each include at least three lobes, and each lobe may include an outer radial portion 2803. At least one adjacent pair of cutting elements 2802 may be placed on the bit face 2000 with a plane of reflection 2810, 2811 being defined therebetween. The plane of reflection 2810, 2811 may be between adjacent cutting elements 2802 in the same circumferential row (see plane 2810), or may be between adjacent cutting elements 2802 in different circumferential rows (see plane 2811). In another embodiment, a plane of reflection may be between adjacent cutting elements 2802 not arranged in rows (not shown).

As shown, cutting elements 2820, 2822 are in the same circumferential row. More particularly, the cutting elements 2820 and 2822 may be in the gage or adjacent-to-gage circumferential row. In FIG. 28 the cutting elements 2820, 2822 have the plane of reflection 2810 therebetween. The first cutting element 2820 may include three lobes, and the second cutting element 2822 may include four lobes, although in other embodiments the cutting elements 2820, 2822 may have the same number of lobes. An outer radial portion 2821 of a lobe of the first cutting element 2820 may be rotated an amount 2825 about the longitudinal axis of the cutting element 2820 from the point of reflection of the outer radial portion 2823 of the nearest lobe of the second cutting element 2822. The first outer radial portion 2821 may be rotated less than 50° from the point of reflection, less than 40° from the point of reflection, less than 30° from the point of reflection, less than 20° from the point of reflection, less than 10° from the point of reflection, or less than 5° from the point of reflection.

In some embodiments, the outer radial portion 2821 of the lobe of the first cutting element 2820 may be rotated 0° from the point of reflection, such that the first and second outer radial portions 2821, 2823 may be in mirrored positions across the plane of reflection 2810. For example, as shown in FIG. 28, an adjacent pair of cutting elements 2830, 2832 has a plane of reflection 2811 therebetween. A lobe of the cutting element 2830 may have an outer radial portion 2831 that is in a mirrored positioned from an outer radial portion 2833 of the nearest lobe of the cutting elements 2832. The cutting elements 2830, 2832 may be in different circumferential rows. More particularly, for instance, the cutting element 2830 may be in the adjacent-to-gage row, and the cutting element 2832 may be in the gage row.

The placement and position of the cutting elements 2802 on the bit face 2800 may be designed to increase the likelihood of crack joining. For example, according to some embodiments, a bit may be designed by modeling a percussion hammer bit having a plurality of cutting elements on the bit face, determining proximity lines between adjacent cutting elements, and modifying at least one cutting element to include a cutting element having at least one crack initiation site. Each crack initiation site may be located proximate an outer radial portion of a lobe of the cutting element. As used herein, a proximity line is used to refer to a line which may be drawn in space from the radial center of a cutting element to the radial center of an adjacent cutting element.

According to embodiments of the present disclosure, the amount of brittle failure generated during impact events of a percussion bit may be increased by considering the percussion bit cutting structure as a system, and positioning neighboring penetration elements (e.g., cutting elements with lobes, semi-round tops, etc.) in such a way to maximize crack joining caused in impact events. Increasing the amount of crack joining, and thus brittle failure, may increase the rate of penetration ("ROP") in the formation by removing more material through brittle failure without increased penetration. Further, in embodiments having cutting elements positioned with rotational and/or translational offsets between adjacent penetration elements, an anti-tracking effect may be imparted on the bit, such that a penetration element in a subsequent impact may not seat directly in an impact crater formed in the previous impact, thus preventing wear due to tracking. Tracking may occur when a penetration element impacts and aligns with a previous impact crater, and may cause premature wear and failure of the bit body. Thus, premature wear and failure of a bit may be minimized using penetration element offsets.

Figure 29:
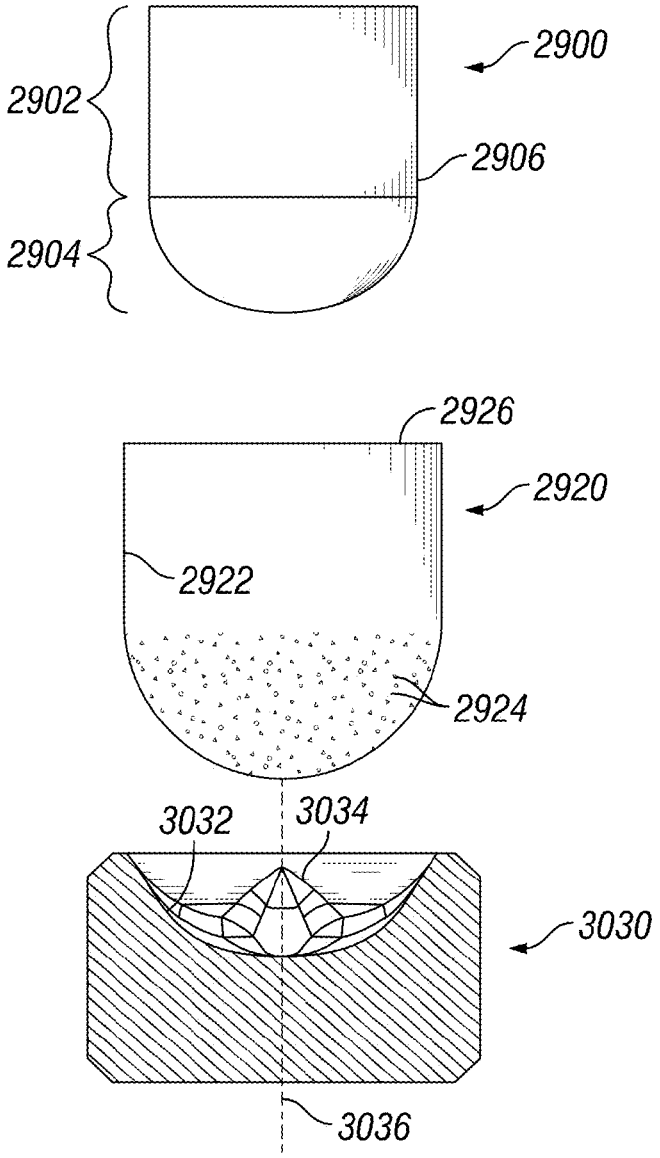
FIG. 29 depicts a partial cross-sectional view of an illustrative assembly for forming a shaped cutting insert, according to one or more embodiments of the present disclosure.

FIG. 29 depicts a partial cross-sectional view of an illustrative assembly for forming a shaped cutting element, according to one or more embodiments of the present disclosure. The assembly illustrated in FIG. 29 may, for instance, be used to form cutting elements having one or more lobes and/or recesses, as described herein. The assembly in FIG. 29 may include a substrate material 2900, a can 2920, and a forming device or button 3030 for forming a shaped cutting element. In some embodiments, a substrate material 2900 may include a base portion 2902 and an extension portion 2904. The base portion 2902 may be substantially cylindrical, and the extension portion 2904 may be tapered in some manner. For instance, the extension portion 2904 may be conical, frustoconical, partially spherical (i.e., a "semi-round top"), or have some other shape. In at least some embodiments, the substrate material 2900 may include a carbide substrate.

In at least some embodiments, the can 2920 may be a hollow shell that is shaped and sized to correspond to, and receive, at least a portion of the substrate material 2900. For instance, the can 2920 may receive the extension portion 2904 therein, or may receive the extension portion 2904 and/or at least some of the base portion 2902. The substrate material 2900 may be inserted through an open end 2926 of the can 2920, and an inner surface 2922 of the can 2920 may be shaped and sized to contact the outer surface 2906 of the substrate material 2900. In another embodiment, however, a small gap (e.g., less than 1 mm) may exist between the inner surface 2922 of the can 2920 and the outer surface 2906 of the substrate material 2900.

The portion of the can 2920 that receives the extension portion 2904 of the substrate material 2900 may be generally conical, frustoconical, or partially spherical (e.g., semi-spherical). In some embodiments, the can 2920 may be made of one or more refractory materials, including metals such as niobium, molybdenum, tantalum, tungsten, rhenium, other materials, or combinations of the foregoing.

A plurality of solid particulates 2924 may be inserted into the can 2920. Examples of solid particulates 2924 may be or include diamond, cobalt, tungsten, cubic boron nitride, other materials, or some combination of the foregoing. In at least some embodiments, the solid particulates 2924 may include highly abrasive or wear-resistant properties. The solid particulates 2924 may have a cross-sectional length ranging from about 0.5 μm to about 75 μm. For example, the average cross-sectional length may be from about 0.5 μm to about 5 μm, about 5 μm to about 10 μm, about 10 μm to about 20 μm, about 20 μm to about 40 μm, about 40 μm to about 75 μm, or about 4 μm to about 30 μm.

Once the solid particulates 2924 have been inserted into the can 2920, the substrate material 2900 may be fully or partially inserted into the can 2920. This may cause the solid particulates 2924 to be positioned between the extension portion 2904 of the substrate material 2900 and the inner surface 2922 of the can 2920. The can 2920 may then be pressed down onto the forming device 3030, as described in greater detail herein. In another embodiment, prior to, or in lieu of, inserting the substrate material 2900 into the can 2920, a punch may be inserted into the can 2920 and used to compact the solid particulates 2924. The punch may, in some embodiments, have a shape similar to that of a substrate material. The substrate material 2900 in FIG. 29 may therefore also represent a punch. In some embodiments, when a substrate material 2900 is inserted into the can, compacting the solid particulates 2924 may cause the solid particulates 2924 to form a solid mass that are press-fit together and/or to the outer surface of the extension portion 2904. The solid mass may also be bonded to the extension portion 2904 (e.g., using a separate high-pressure, high-temperature (HPHT) process). When a punch other than the substrate material 2900 is used, the punch may form the solid particulates 2924 into a solid mass, but the solid mass may be configured to be separable from the punch to allow a substrate material 2900 to subsequently be inserted and bonded (e.g., using a HPHT process) to the mass of solid particulates 2924.

In an example embodiment, the substrate material 2900 may have a semi-round top, and the can 2920 may have a corresponding semi-round top. In other embodiments, however, the substrate material 2900 and/or can 2920 may have different matched or unmatched configurations. For instance, the can 2920 may be pre-formed with one or more lobes and/or reliefs prior to receiving the solid particulates 2924 and/or prior to contacting the forming device 3030. In the same or other embodiments, the substrate material 2900 or punch may be pre-formed to have one or more lobes or reliefs. In some embodiments, the pre-formed lobes and/or reliefs in the substrate material 2900 or punch may match pre-formed lobes and/or reliefs in a can 2920; however, in other embodiments, the pre-formed lobes and/or reliefs in the substrate material 2900 or punch may not match the shape of the can 2920 (e.g., the can 2920 may be of a generic shape or have different lobes/reliefs formed therein).

The forming device 3030 may include an inner surface 3032 that is shaped and sized to receive the curved outer surface 2906 of the substrate material 2900 (or punch) and the can 2920. The inner surface 3032 of the forming device 3030 may have a radius of curvature ranging from about 1 mm to about 50 mm or more in some embodiments. For instance, the inner surface 3032 of the forming device 3030 may have a radius from about 1 mm, about 2 mm, about 5 mm, or about 10 mm to about 15 mm, about 20 mm, about 30 mm, about 40 mm, about 50 mm, or more. For example, the radius of curvature may be from about 1 mm to about 5 mm, about 5 mm to about 15 mm, about 10 mm to about 20 mm, about 15 mm to about 30 mm, about 20 mm to about 40 mm, or about 3 mm to about 20 mm.

The inner surface 3032 of the forming device 3030 may include one or more protrusions 3034 (one is shown in the cross-sectional view in FIG. 29) extending therefrom. In at least one embodiment, the forming device 3030 may include two or more protrusions 3034 that are circumferentially offset from one another about a central longitudinal axis 3036 through the forming device 3030. The protrusions 3034 may be arranged and designed to deform the can 2920 and optionally the extension portion 2904 of the substrate material 2900 (or a punch) to form one or more reliefs (e.g., reliefs 128-1, 128-2 in FIG. 3) therein when the substrate material 2900 or punch, and the can 2920, are pressed onto the forming device 3030. Recesses or reliefs within the forming device 3030 may be used to define the lobes (e.g., lobes 122-1, 122-2 in FIG. 3) in the substrate material 2900. The protrusions 3034 may also be arranged and designed to form the solid particulates 2924 into a solid mass that also has one or more reliefs therein, and which generally conforms to the deformed shape of the can 2920 and/or the substrate material 2900.

Figure 30:
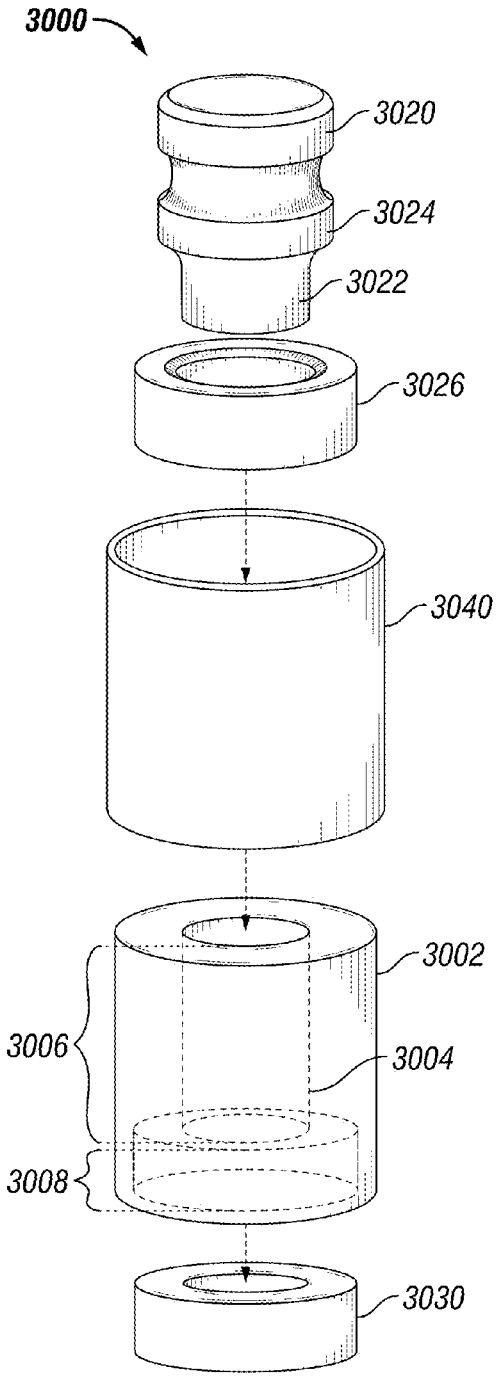
FIG. 30 depicts a perspective view of an illustrative pressing assembly for forming a shaped cutting insert, according to one or more embodiments of the present disclosure.

FIG. 30 depicts an exploded perspective view of an illustrative pressing assembly 3000 including a forming device 3030, according to one or more embodiments of the present disclosure. According to some embodiments, the pressing assembly 3000 may include a sleeve 3002, a compressing device 3020, and the forming device 3030. The sleeve 3002 may be made of any suitable material, including a polymer, such as polyurethane, epoxy, polyester, phenolics, other materials, or combinations thereof. In other embodiments, the sleeve 3002 may be formed of other materials, including metals, composites, organic materials (e.g., wood), other materials, or some combination of the foregoing.

The sleeve 3002 may be generally cylindrical or annular in some embodiments, and may have a bore 3004 formed at least partially therethrough. The bore 3004 may include a first diameter portion 3006 that transitions to a second, greater diameter portion 3008, as shown in FIG. 30. The first diameter portion 3006 may be sized and shaped to receive a substrate material 2900 (or punch) and a can 2920 of FIG. 20, and the second diameter portion 3008 may be sized and shaped to receive the forming device 3030. The substrate material 2900 and can 2920 (see FIG. 29) may be inserted into the first diameter portion 3006 of the bore 3004, and the forming device 3030 may be inserted into the second diameter portion 3008 of the bore 3004. In some embodiments, protrusions 3034 (see FIG. 31) of the forming device may extend at least partially into the first diameter portion of the bore 3004. In other embodiments, the protrusions 3034 may be positioned within the second diameter portion 3008 of the bore 3004, and a portion of the substrate may extend into the second diameter portion 3008 of the bore 3004. In at least one embodiment, the forming device 3030 may be integral with the sleeve 3002.

The compression device 3020 may include a shaft 3022 that is configured to apply a compression force to the substrate material 2900, which may be positioned between the shaft 3022 and the forming device 3030. In some embodiments, the shaft 3022 may be shaped and sized to optionally fit and/or move within at least a portion of the first diameter portion 3006 of the bore 3004 of the sleeve 3002, and to move coaxially and/or along a longitudinal axis thereof. A shoulder 3024 on the compression device 3020 may limit axial movement with respect to the sleeve 3002. The shoulder 3024 may contact the sleeve 3002 directly, although in other embodiments a ring 3026 disposed between the compression device 3020 and the sleeve 3002, may engage the shoulder 3024. In other embodiments the shoulder 3024 may contact other structures.

Figure 31:
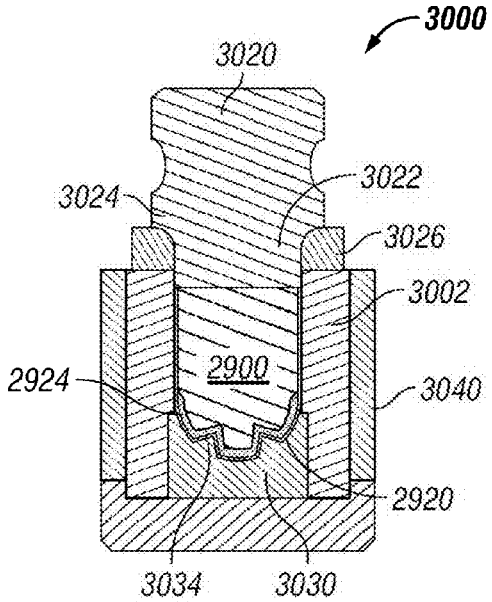
FIG. 31 depicts a cross-sectional side view of a pressing assembly for forming a shaped cutting insert, according to one or more embodiments of the present disclosure.

FIG. 31 depicts a cross-section side view of the pressing assembly 3000 with the substrate material 2900, solid particulates 2924, and can 2920 therein, according to one or more embodiments. In accordance with some embodiments of the present disclosure, the substrate material 2900 may be positioned within the deformable can 2920, along with the solid particulates 2924. The compression device 3020 may apply a force to the base 2902 (see FIG. 29) of the substrate material 2900. The applied force may move the substrate material 2900, solid particulates 2924, and the can 2920 downward toward the forming device 3030. The force exerted by the compression device 3020 may range from about 500 N to about 10,000 N. For example, the force may range from about 500 N to about 1,000 N, about 1,000 N to about 2,500 N, about 2,500 N to about 5,000 N, or about 5,000 N to about 10,000 N.

The force exerted by the compression device 3020 on the substrate material 2900 and can 2920 may cause the can 2920, solid particulates 2924, and substrate material 2900 to deform into a shape defined by the forming device 3030. The applied force may further cause the solid particulates 2924 to become a solid mass and press-fit or otherwise bonded to the outer surface 2906 of the extension portion 2904 of the substrate material 2900. If the substrate material 2900 is replaced with a punch, the solid particulates 2924 may define a solid mass that is removable from the punch.

The applied force may cause the protrusions 3034 of the forming device 3030 to gouge into and deform the can 2920 and the extension portion 2904 of the substrate material 2900, thereby forming one or more reliefs (e.g., 128-1, 128-2 in FIG. 3) in the extension portion 2904 of the substrate material 2900. The reliefs may also be formed in the mass of solid particulates 2924 which may generally conform to the shape of the forming device 3030, the can 2920, the substrate material 2900, or some combination of the foregoing. As discussed herein, in other embodiments, the reliefs in the can 2920 or substrate material 2900 (or punch) may be pre-formed so as to not be formed, or at least not fully formed, from force used to form the solid particulates 2924 into a solid mass. In at least one embodiment, a second sleeve 3040 may be disposed about the sleeve 3002 to help the sleeve 3002 maintain rigidity during the pressing process. The second sleeve 3040 may be made of a metal or metal alloy material (e.g., steel, tungsten carbide, etc.).

Once pressing is complete, or potentially during pressing, the substrate material 2900 (and the solid particulates 2924 now coupled or adjacent thereto) may be exposed to a high pressure-high temperature ("HPHT") process, e.g., while inside the pressing assembly 3000. The solid particulates 2924 may generally be positioned on the exterior of the extension portion 2920 of the substrate material 2900, and may form a layer of diamond crystals or grains. The substrate material 2900 and adjacent layer of solid particulates 2924 may then be sintered under the HPHT conditions. The high pressure and high temperature conditions may cause the solid particulates 2924 (e.g., diamond crystals or grains) to bond to one another to form polycrystalline diamond with diamond-to-diamond bonds. Additionally, in some embodiments a catalyst may be employed for facilitating formation of the polycrystalline diamond or other layer formed by the solid particulates 2924. In one example, a solvent catalyst may be employed for facilitating the formation of a matrix or other layer of solid particulates 2924. For example, cobalt, nickel, and iron are some illustrative examples of solvent catalysts that may be used in forming polycrystalline diamond.

Within the HPHT process, the pressure may range from about 3 GPa to about 8 GPa. For example, the pressure may range from about 4 GPa to about 5 GPa, 4.5 GPa to about 5.5 GPa, 5 GPa to about 6 GPa, 5.5 GPa to about 6.5 GPa, 6 GPa to about 7 GPa, 6.5 GPa to about 7.5 GPa, or about 7 GPa to about 8 GPa. The temperature may range from about 1,200° C. to about 1,800° C. For example, the temperature may be from about 1,200° C. to about 1,300° C., about 1,300° C. to about 1,400° C., about 1,400° C. to about 1,500° C., about 1,500° C. to about 1,600° C., about 1,600° C. to about 1,700° C., or about 1,700° C. to about 1,800° C. The pressing process (e.g., via the pressing assembly 3000) and the HPHT process may convert or transform the substrate material 2900 and solid particulates 2924 into a shaped cutting insert (e.g., cutting insert 100 in FIG. 3). The time for the HPHT process may range from about 1 minute to about 240 minutes in some embodiments. For instance, the solid particulates 2924 and substrate material 2900 may be subjected to an HPHT process for between about 1 minute and about 10 minutes, between about 10 minutes and about 30 minutes, between about 30 minutes and about 60 minutes, between about 60 minutes and about 120 minutes, or between about 120 minutes and about 240 minutes. In an embodiment in which a punch separate from a substrate material 2900 is used, the punch may be separated from the solid particulates 2924, which may then be positioned on an already formed substrate material 2900 (i.e., a preformed substrate material having a shape—potentially including lobes and/or reliefs—arranged and designed to mate with the formed layer of solid particulates). The substrate material 2900 and solid particulates 2924 may then be subjected to the HPHT process. When subjecting the substrate material 2900 and solid particulates 2924 to the HPHT process, the substrate material 2900 and solid particulates 2924 may be placed within the same pressing assembly (e.g., pressing assembly 3000) used to form the solid particulates 2924 into a solid mass, and may or may not include the can 2920. In other embodiments, the HPHT process may occur in a separate pressing assembly.

In accordance with at least some embodiments of the present disclosure, one or more elements may be provided for use during an HPHT or other forming process to allow reliefs and/or lobes formed in the substrate material 2900 and/or solid particulates 2924 to maintain their shape even after processing is complete. In one embodiment, for instance, the forming device 3030 in FIG. 31 may include or be replaced by a salt cap. Such a salt cap may provide a negative impression formed to correspond to the shape of the reliefs/lobes in the layer of solid particulates 2924. The salt cap may be part of the forming device 3030 during an initial pressing process used to form the solid particulates 2924 into a solid mass and/or during an HPHT process. In at least one embodiment, following forming of the solid particulates 2924 into a solid mass and prior to HPHT processing, the forming device 3030 may be replaced with a salt cap (e.g., which may also have the same general form as forming device 3030 of FIG. 31). In other embodiments, loose salt may be added between the forming device 3030 and the mass of solid particulates 2924 prior to HPHT processing (and potentially prior to initial pressing). A salt cap or loose salt may be useful for causing the solid particulates 2924 and/or substrate material 2900 to retain their shape after HPHT processing is complete.

As used herein, the terms "inner" and "outer"; "upper" and "lower"; "upward" and "downward"; "inward" and "outward"; and other like terms as used herein refer to relative positions to one another and are not intended to denote a particular direction or spatial orientation. The terms "couple," "coupled," "connect," "connection," "connected," and the like refer to both a direct connection and an indirect connection (i.e., a connection via another element or member.)

Although only a few example embodiments have been described in detail herein, those skilled in the art will readily appreciate that many modifications are possible in the example implementation without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. All additions, deletions and modifications to the embodiments that fall within the meaning and scopes of the claims are to be embraced by the claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. All numerical values are "about" or "approximately" the indicated value, and take into account experimental error and variations that would be expected by a person having ordinary skill in the art.

What is claimed is:

1. A method for forming a cutting insert, comprising:

inserting a plurality of solid particulates into a substantially hollow can;

inserting a substrate material into the substantially hollow can, the substrate material having a base portion and an extension portion;

inserting the substantially hollow can, substrate material, and plurality of solid particulates into a bore of a sleeve;

engaging the substantially hollow can with a forming device having at least one protrusion; and applying a force to the substrate material within the substantially hollow can, the force causing the at least one protrusion to deform the substantially hollow can while the plurality of solid particulates and substrate material are therein.

2. The method of claim 1, wherein inserting the plurality of solid particulates is performed prior to inserting the substrate material into the substantially hollow can.

3. The method of claim 1, wherein inserting the substrate material causes the plurality of solid particulates to become positioned between the substrate material and an interior surface of the substantially hollow can.

4. The method of claim 1, wherein the substrate material includes a carbide substrate.

5. The method of claim 1, wherein applying the force further causes the at least one protrusion to deform the extension portion of the substrate material.

6. The method of claim 5, wherein applying the force causes the at least one protrusion to form at least one relief and at least one lobe in the extension portion.

7. The method of claim 6, further comprising:

heating the substrate material and plurality of solid particulates to a temperature between about 1,200° C. and about 1,600° C. after the at least one relief has been formed in the extension portion.

8. The method of claim 1, wherein applying the force includes applying a compressive force using a shaft arranged and designed to fit within the bore.

9. The method of claim 8, wherein the shaft is part of a compression device, the compression device having a shoulder for restricting axial movement of the shaft within the bore.

10. A method for forming a cutting insert, comprising:

inserting a plurality of diamond particles into a deformable can;

inserting a punch into the deformable can such that the plurality of diamond particles is between the punch and an interior surface of the can;

inserting the punch, the plurality of diamond particles, and the deformable can at least partially into a compression device, the compression device including a forming device with at least one protrusion; and applying a compressive force to the punch, the compressive force causing the at least one protrusion to deform the can and the punch, the punch having at least one lobe and at least one relief formed in a deformed portion thereof, wherein the compressive force further causes the plurality of diamond particles to form a substantially solid layer.

11. The method of claim 10, wherein the punch comprises a carbide substrate.

12. The method of claim 11, further comprising:

heating the carbide substrate and the substantially solid layer to a temperature from about 1,200° C. to about 1,600° C.; and exposing the carbide substrate and the substantially solid layer to a pressure from about 5 GPa to about 7 GPa.

13. The method of claim 11, further comprising:

subjecting the carbide substrate and the substantially solid layer to an HPHT process; and exposing the substantially solid layer to salt during the HPHT process.

14. The method of claim 10, wherein applying the compressive force includes applying a compressive force from about 500 N to about 10,000 N.

* * * * *